US011624543B2

(12) United States Patent
Lee et al.

(10) Patent No.: US 11,624,543 B2
(45) Date of Patent: Apr. 11, 2023

(54) UNDER COUNTER TYPE REFRIGERATOR

(71) Applicant: LG ELECTRONICS INC., Seoul (KR)

(72) Inventors: Sanggyun Lee, Seoul (KR); Younseok Lee, Seoul (KR); Dongseok Kim, Seoul (KR); Yongwon Dong, Seoul (KR); Chungseob Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 159 days.

(21) Appl. No.: 16/992,905

(22) Filed: Aug. 13, 2020

(65) Prior Publication Data

US 2021/0063072 A1 Mar. 4, 2021

(30) Foreign Application Priority Data

Aug. 26, 2019 (KR) ..... 10-2019-0104741
Aug. 26, 2019 (KR) ..... 10-2019-0104742

(51) Int. Cl.
*F25D 13/04* (2006.01)
*F25D 21/14* (2006.01)
(Continued)

(52) U.S. Cl.
CPC ..... *F25D 13/04* (2013.01); *F25D 17/045* (2013.01); *F25D 17/067* (2013.01); *F25D 21/14* (2013.01);
(Continued)

(58) Field of Classification Search
CPC ..... F25D 13/04; F25D 17/045; F25D 21/14; F25D 29/005; F25D 23/003;
(Continued)

(56) References Cited

U.S. PATENT DOCUMENTS 3,162,023 A * 12/1964 Smith ..... F25D 23/003 62/289
4,490,992 A * 1/1985 Chastine ..... F25D 21/14 62/448
(Continued)

FOREIGN PATENT DOCUMENTS

CN 103827609 A 5/2014
CN 110068073 A 7/2019
(Continued)

*Primary Examiner* — Lionel Nouketcha
(74) *Attorney, Agent, or Firm* — Dentons US LLP

(57) ABSTRACT

A under counter refrigerator includes a main body defining at least one of a first and second storage compartments, an evaporator to generate cool air to be supplied to the at least one of the first and second storage compartments, and a machine room provided at a lower portion of the main body to define an installation space in which a compressor and a condenser are provided. The machine room includes a suction portion provided in front of the main body to suction outside air into the machine room, a discharge portion provided in front of the main body to discharge the suctioned air in the machine room, a guide wall to separate the installation space into a first space in which the condenser is installed, and a second space in which the compressor is installed. A condensation fan is installed at the guide wall, the condenser is provided in a front portion of the first space, a defrosting water tray is provided at a rear of the condenser, and the condensation fan is disposed on one side of the defrost water tray.

19 Claims, 29 Drawing Sheets

(51) Int. Cl.
*F25D 29/00* (2006.01)
*F25D 17/04* (2006.01)
*F25D 17/06* (2006.01)

(52) U.S. Cl.
CPC ..... *F25D 29/005* (2013.01); *F25D 2317/043* (2013.01); *F25D 2317/068* (2013.01)

(58) Field of Classification Search
CPC . F25D 2323/00264; F25D 2323/00274; F25D 23/10
See application file for complete search history.

(56) References Cited

U.S. PATENT DOCUMENTS 5,881,567 A * 3/1999 Junge ..... F25D 23/003 62/428
7,062,936 B2 * 6/2006 Rand ..... F25D 11/022 62/352
7,886,559 B2 * 2/2011 Hell ..... F25D 29/005 62/298
7,987,684 B2 * 8/2011 Jeong ..... F25D 23/003 62/407
8,337,155 B2 * 12/2012 Yoo ..... F04D 29/522 361/679.48
2004/0182100 A1 * 9/2004 Lee ..... F25D 21/14 62/288
2005/0160760 A1 * 7/2005 Chae ..... F25D 23/006 62/507
2005/0178139 A1 * 8/2005 Kim ..... F25D 23/04 62/277
2011/0148567 A1 * 6/2011 Lafond ..... H04L 67/12 340/4.3
2012/0117999 A1 * 5/2012 Chae ..... F25D 21/14 62/291
2012/0125038 A1 * 5/2012 Oh ..... F25D 23/003 62/428
2018/0031310 A1 * 2/2018 Kendall ..... F25D 27/00

FOREIGN PATENT DOCUMENTS

EP 1378717 A1 1/2004
EP 2762809 A1 8/2014
EP 2881687 A1 6/2015
JP 52150857 U 11/1977
JP H0436570 A 2/1992
JP H05203333 A 8/1993
JP 08-180968 A 7/1996
JP 2000337752 A 12/2000
JP 2003097880 A 4/2003
WO 03031889 A1 4/2003

* cited by examiner

UNDER COUNTER TYPE REFRIGERATOR

CROSS-REFERENCE TO RELATED APPLICATIONS

The present application claims priority under 35 U.S.C. 119 and 35 U.S.C. 365 to Korean Patent Application No. 10-2019-0104741 (filed on Aug. 26, 2019) and No. 10-2019-0104742 (filed on Aug. 26, 2019), which are hereby incorporated by reference in its entirety.

BACKGROUND

The present disclosure relates to an under counter type refrigerator.

In general, refrigerators are home appliances for storing food at a low temperature in a storage space that is covered by a door.

Recently, products in which furniture and household appliances are combined have appeared, and an under counter type refrigerator is a type of refrigerator that is installed on a table or sink located in the kitchen and has attracted many choices from consumers.

Since the user takes out beverages or ingredients from the nearby refrigerator while the user eats at the dining table or cooks at the sink, convenience in use may be improved.

Information related to the prior art with respect to the under counter type refrigerator document is as follows.

1. Patent Publication Number (Date of Publication): Japanese Patent Application No. Hei 8-180968 (Jul. 12, 1996)

2. Title of the invention: UNDER COUNTER TYPE REFRIGERATOR

In the case of the under counter type refrigerator, since the refrigerator has to be installed at a height less than that of the table or sink, the refrigerator may be limited in size.

The refrigerator has to include components of a refrigeration cycle for generating cool air, i.e., a compressor, a heat exchanger, and a valve device. However, the refrigerator is limited in capacity of a storage compartment thereof due to a capacity of the machine room in which the components are installed.

Particularly, when a plurality of storage compartments are provided in the refrigerator, and two or more evaporators have to be installed so as to realize independent storage temperatures when different types of storage are stored in the plurality of storage compartments, a storage compartment of the refrigerator may be limited due to volumes of the evaporator installation space and the machine room.

If any one of the plurality of storage compartments is provided as a freezing compartment or a convertible storage compartment, in which a freezing compartment and a refrigerating compartment are switchable, it is necessary to install an evaporator for the freezing compartment in the storage compartment. Since the evaporator for the freezing compartment has a relatively large volume, the storage compartment of the refrigerator may be limited in capacity.

SUMMARY

Embodiments provide an under counter type refrigerator, in which a compact machine room is realized to increase a capacity of the storage compartment.

Embodiments also provide an under counter type refrigerator in which a height of a machine room is relatively low so as not to largely reduce a capacity of a storage compartment even though the refrigerator decreases in height.

Embodiments also provide an under counter type refrigerator in which a heat dissipation passage of a machine room, through which air is suctioned from the front into and discharged from the machine room, is provided.

Embodiments also provide an under counter type refrigerator, in which a machine room is divided into left and right sides with respect to a guide wall of the machine room, and a compressor and a condenser are respectively installed in the divided left and right spaces to improve space efficiency of components.

Embodiments also provide an under counter type refrigerator, in which a machine room has different heights including a region having a relatively high height so that a compressor is disposed and a region having a relatively low height in which a condenser is disposed, to increase a capacity of a storage compartment.

Embodiments also provide an under counter type refrigerator, in which a suction passage defined towards the back from a front surface of the refrigerator is provided, and a condensation fan is disposed to be inclined at a predetermined angle from the front surface to increase a suction capacity of air.

Embodiments also provide an under counter type refrigerator, in which two evaporators are disposed to realize independent temperatures for each storage compartment, and particularly, realize a freezing compartment.

Embodiments also provide an under counter type refrigerator, in which defrosting water generated in an evaporator is transferred to a machine room so as to be evaporated.

Embodiments also provide an under counter type refrigerator which is improved in user's convenience in smart lighting of a storage compartment of the refrigerator, touch open and auto closing function of a door, a touch smart shelf, and convertible temperature control function for a storage compartment.

An under counter type refrigerator according to an embodiment includes two or more evaporators configured to realize independent temperatures in a plurality of storage compartments, wherein a machine room is lowered in height to increase a capacity of the storage compartments.

In addition, a guide wall may be provided between spaces in which a compressor and a condenser, which are provided in the machine room, are respectively installed, and air passing through the condenser may pass through the compressor to easily provide a heat dissipation passage.

Particularly, a suction passage through which the air is suctioned from a front side of the machine room to flow towards the back may be provided in a front and rear direction, and a discharge passage through which the air is discharged forward from a rear side of the machine room may be provided in the front and rear directions to realize the compact suction passage and discharge passage.

For example, a condensation fan configured to generate a flow of the air may be disposed to be inclined at a set angle with respect to a front surface of the machine room, thereby increasing in suction capacity of the air. For example, the set angle may be defined in a range of about 35° to about 55° so that the air passing through the suction passage passes through the condensation fan, and then is easily introduced into the discharge passage.

The guide wall may be inclined or rounded in the back from the front side, and the suction passage may be narrowed in width in the back by the guide wall to sufficiently secure a flow rate of the air suctioned into a blowing fan.

A tray pipe may be provided behind the condenser, and defrosting water stored in a tray may be easily evaporated by a high-temperature refrigerant flowing through the tray pipe.

In view of a flow of the refrigerant, the high-temperature refrigerant discharged from the compressor may pass through the tray pipe, and then flow to the condenser so that the refrigerant passing through the tray pipe increases in heat generation amount.

In one embodiment, an under counter type refrigerator is installed in at least one or more storage spaces of a plurality of storage spaces in kitchen furniture provided with a main body having a first width (W1) in a left and right direction, which is greater than a second width (W2) in a front and rear direction or a third width (W3) in a vertical direction, and the plurality of storage spaces arranged in the left and right direction.

The under counter type refrigerator includes: a main body configured to define first and second storage compartments; first and second evaporators configured to generate cool air to be supplied to the first and second storage compartments; and a machine room provided in a lower portion of the main body to define an installation space in which a compressor and a condenser are provided.

The machine room includes: a suction portion provided in front of the main body to suction air into the machine room; a discharge portion provided in front of the main body to discharge the air in the machine room forward; a guide wall configured to separate the installation space into a first space, in which the condenser is installed, and a second space, in which the compressor is installed; and a condensation fan installed in the guide wall.

The first space may define a rear space of the suction portion, and the second space may define a rear space of the discharge portion.

The machine room may include a lower plate and side plates disposed on both sides of the lower plate and the installation space is defined by the lower plate and the side plates.

The guide wall may protrude upward from the lower plate.

The guide wall may extend backward from a front portion of the lower plate, and the first and second spaces may be defined in the left and right direction with respect to the guide wall.

A width (C) of the first space in the left and right direction may be greater than a width (E) of the second space in the left and right direction with respect to a front portion of the guide wall.

A width (A2) of the second space in the left and right direction may be greater than a width (A1) of the first space in the left and right direction with respect to a rear portion of the guide wall.

The guide wall may include: a first part extending linearly in the front and rear direction; and a second part extending to be inclined or rounded in the back from the first part.

The width (C) of the front portion of the first space may be defined as a distance between the first part and the side plate, and a width (D) of the rear portion of the first space may be defined as a distance between the second part and the side plate.

The width (C) of the front portion of the first space may be greater than the width (D) of the rear portion of the second space.

The condensation fan may be provided at a rear side of the guide wall, and the compressor and the condensation fan may be aligned in the left and right direction.

A first center (Co) of the compressor in the vertical direction and a second center (C1) of the condensation fan in the vertical direction may be defined at the same height.

The machine room may further include an upper plate configured to define a bottom surface of the main body, and the upper plate may include a first upper plate disposed above the condensation fan and a second upper plate disposed above the compressor.

The first and second upper plates may be disposed at heights different from each other.

A first distance (H5) from the lower plate to the first upper plate may be greater than a second distance (H6) from the lower plate to the second upper plate.

The machine room may include: an inclined plate extending to be downwardly inclined forward from the first and second upper plates; and a front plate extending forward from the inclined plate.

A third distance (H4) from the lower plate to the front plate may be less than each of the first distance (H5) and the second distance (H4).

The machine room may include: a defrosting water tray placed on an upper portion of the lower plate to store defrosting water; and a tray pipe which is provided in the defrosting water tray and through which a refrigerant compressed in the compressor flows.

The machine room may further include a control box installed in the second space.

The control box is disposed in front of the compressor.

The main body may include an inner case configured to define inner walls of the first and second storage compartments, an outer case configured to define an outer appearance, and an insulating material provided between the inner case and the outer case.

A wall condenser through which a refrigerant condensed in the condenser flows may be embedded in the insulating material, and the wall condenser may include a portion, which disposed in each of both sidewalls of the main body.

The wall condenser may include: a first condensation portion provided on a front surface of the main body; and second and third condensation portions provided on both sides of the first condensation portion to extend to be bent one or more times in the vertical direction.

The under counter type refrigerator may further include: a lighting provided inside the main body; and a proximity sensor configured to sense a user's access, wherein a turn-on operation of the lighting may be selectively performed according to the sensing of the user's access through the proximity sensor.

The under counter type refrigerator may further include a door provided to be openable in front of the main body and a drawer provided to be withdrawable in front of the main body, wherein the door and the drawer may move by manipulation of a touch sensor.

The under counter type refrigerator may further include a shelf provided inside the main body, wherein the shelf may be provided to be withdrawable by manipulation of a touch sensor.

One of the first and second storage compartments may be provided as a convertible storage compartment in which food is stored in a frozen or refrigerated state.

In another aspect, the machine may further include a suction passage of the condensation fan, which is defined in the first space; and a discharge passage of the condensation fan, which is defined in the second space, wherein the condensation fan may be disposed to be inclined with respect to the suction passage or the discharge passage.

The machine room may include a front surface and a rear surface, and the suction passage and the discharge passage may be defined from the front surface towards the rear surface in the front and rear direction.

An extension line perpendicular to an axial line of the condensation fan may be inclined at a set angle with respect to the rear surface.

The set angle may be defined in a range of about 35° to about 55°.

The set angle may be defined at substantially about 45°.

The condensation fan may include an axial flow fan.

The machine room may further include: a suction portion which is provided in front of the main body and through which air is suctioned into the machine room; and a discharge portion which is provided in front of the main body and through which the air within the machine room is discharged forward.

The guide wall may extend to rear sides of the suction portion and the discharge portion.

The machine room may include a lower plate and side plates disposed on both sides of the lower plate and the installation space is defined by the lower plate and the side plates.

The axial line of the condensation fan may meet the side plate.

The guide wall may protrude upward from the lower plate to extend in the front and rear direction, and the first and second spaces may be defined in the left and right direction with respect to the guide wall.

The guide wall may include: a first part extending linearly in the front and rear direction; and a second part extending to be inclined or rounded from the back of the first part.

The width (C) of the front portion of the first space may be defined as a distance between the first part and the side plate, and a width (D) of the rear portion of the first space may be defined as a distance between the second part and the side plate.

The width (C) of the front portion of the first space may be greater than the width (D) of the rear portion of the second space.

The details of one or more embodiments are set forth in the accompanying drawings and the description below. Other features will be apparent from the description and drawings, and from the claims.

DETAILED DESCRIPTION OF THE EMBODIMENTS

Hereinafter, exemplary embodiments will be described with reference to the accompanying drawings. The invention may, however, be embodied in many different forms and should not be construed as being limited to the embodiments set forth herein; rather, that alternate embodiments included in other retrogressive inventions or falling within the spirit and scope of the present disclosure will fully convey the concept of the invention to those skilled in the art.

Figure 1:
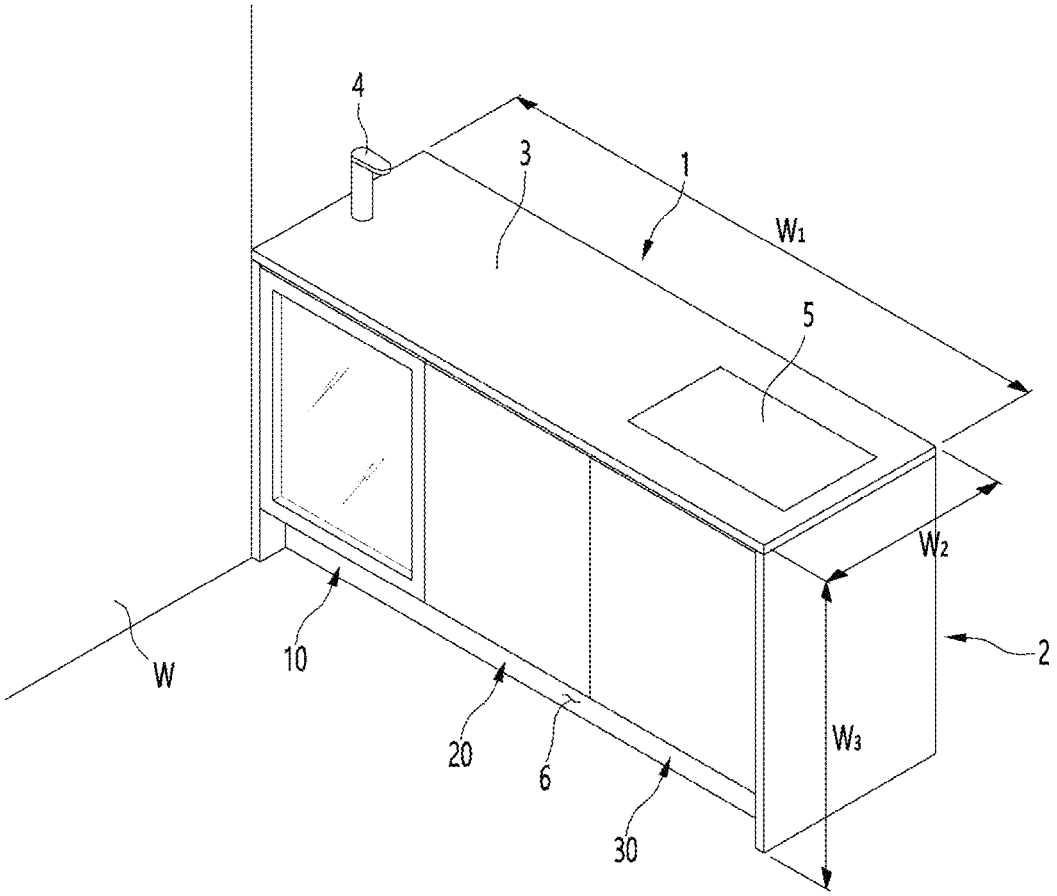
FIG. 1 is a perspective view illustrating a state in which an under counter type refrigerator is installed in a kitchen furniture according to an embodiment.
Figure 2:
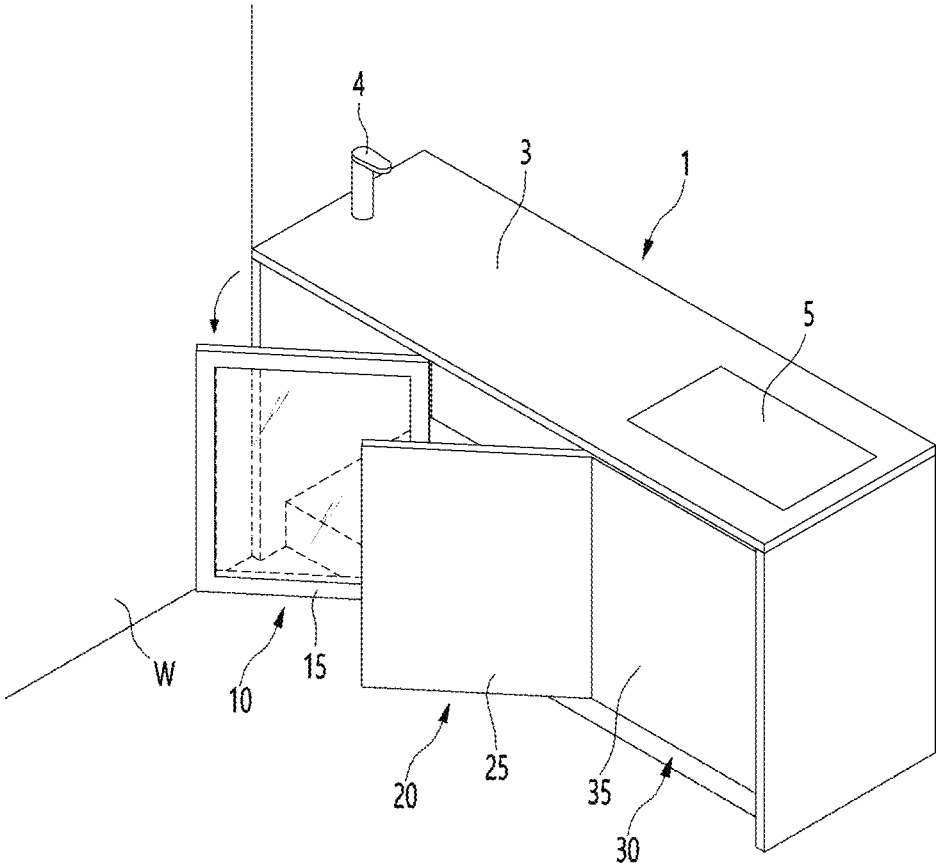
FIG. 2 is a view illustrating a state in which a door of the under counter type refrigerator is opened according to an embodiment.
Figure 3:
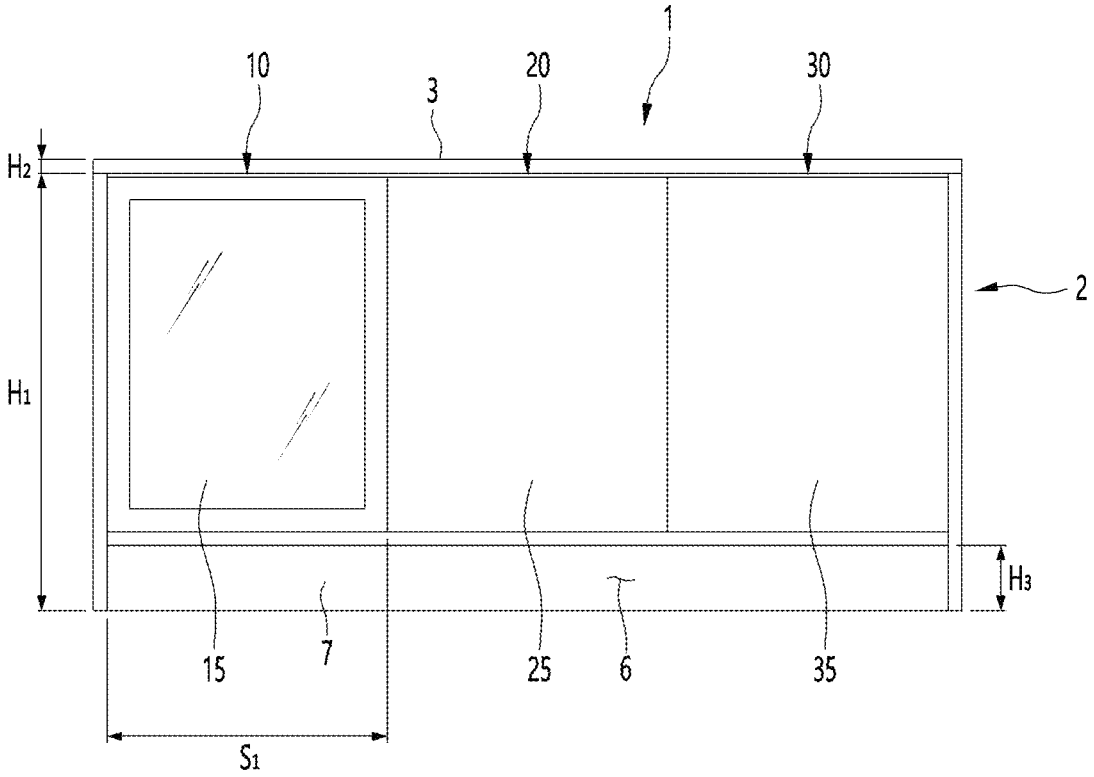
FIG. 3 is a front view illustrating the state in which the under counter type refrigerator is installed in the kitchen furniture according to an embodiment.

FIG. 1 is a perspective view illustrating a state in which an under counter type refrigerator is installed in a kitchen furniture according to an embodiment, FIG. 2 is a view illustrating a state in which a door of the under counter type refrigerator is opened according to an embodiment, and FIG. 3 is a front view illustrating the state in which the under counter type refrigerator is installed in the kitchen furniture according to an embodiment.

Referring to FIGS. 1 to 3, an under counter type refrigerator according to an embodiment may be installed in a kitchen furniture 1.

For example, the kitchen furniture 1 may include a dining table that extends in one direction from a wall W in a region that is a boundary between the kitchen and the living room to eat or cook food. The kitchen furniture 1 may be referred to as an "Irish dining table".

The kitchen furniture 1 includes a substantially rectangular parallelepiped-shaped furniture body 2 and an upper plate 3 defining a top surface of the furniture 1.

A recess 6 that is recessed backward from a front surface of the furniture body 1 is to provide a wash board.

The recess 6 is provided with a lower cover 7. The lower cover 7 may be understood as a cover that covers a lower front surface of the refrigerator. A through-hole through which air is suctioned into the refrigerator or air is discharged from the refrigerator may be defined in the lower cover 7.

The upper plate 3 may be coupled to an upper portion of the furniture body 2.

Kitchen facilities or household appliances may be installed on the upper plate 3. For example, a water purifier 4 and a cooking appliance 5 may be provided on the upper plate 3.

The furniture 1 may be determined in dimension by a width W1 in a first direction, a width W2 in a second direction, and a width W3 in a third direction. For example, the first direction may be a direction extending perpendicular to the wall W, and the width W1 in the first direction may define a length of the furniture 1 in a horizontal (left and right) direction and be adjusted according to a size of the kitchen or living room.

The width W2 in the second direction may define a length of the furniture 1 in a front and rear direction, and the width W3 in the third direction may define a height of the furniture 1.

In general, the width W1 in the first direction may be greater than each of the widths W2 and W3 in the second and third directions. Also, the width W3 in the third direction may be slightly larger than the width W2 in the second direction.

For example, the width W1 in the first direction may be determined to be in a range of about 1,000 mm to about 2,500 mm, the width W2 in the second direction may be determined to be in a range of about 500 mm to about 700 mm, and the width W3 in the third direction may be determined to be in a range of about 700 mm to about 1,000 mm.

Each of the under counter type refrigerators 10, 20 and 30 may be installed in the furniture body 2. In other words, the under counter type refrigerator may constitute the furniture body 2.

The plurality of under counter type refrigerators may be provided in the furniture body 2. For example, the under counter type refrigerator includes a first refrigerator 10, a second refrigerator 20, and a third refrigerator 3.

The first to third refrigerators 10, 20, and 30 may be arranged in the horizontal direction. The first to third refrigerators 10, 20, and 30 may be provided as separate refrigerators that are separated from each other to perform independent functions. For example, the first refrigerator 10 may be a refrigerator that stores drinks or wine. The second refrigerator 20 may be a convertible refrigerator capable of switching (refrigerating or freezing) the storage compartment. The third refrigerator 30 may be a refrigerating compartment-dedicated refrigerator or a freezing compartment-dedicated refrigerator.

However, these types of refrigerators may be variously combined according to user preferences. Therefore, the types of refrigerators will not be limited to any one.

Also, although the first refrigerator 10, the second refrigerator 20, and the third refrigerator 30 are sequentially arranged in the drawings, the first refrigerator 10 may be disposed between the second and third refrigerators 20 and 30, unlike the above-described arrangement.

A first door 15 is provided on a front surface of the first refrigerator 10. The first door 15 may be hinge-coupled to a refrigerator body and rotate forward to be opened. Similarly, a second door 25 that is hinge-coupled to the refrigerator body and rotates forward to be opened is provided on a front surface of the second refrigerator 20.

The third refrigerator 30 includes a third door 35 provided to be withdrawable forward. A basket in which food is stored may be provided behind the third door 35.

An opening and closing manner of the refrigerator door, i.e., a rotating type or sliding type may be variously combined. That is, each of the first refrigerator 10 and the second refrigerator 20 may include a sliding door, and the third refrigerator 30 may include a rotating type door. Thus, the opening and closing manner of the refrigerator door will not be limited to any one.

Referring to FIG. 3, the height of the kitchen furniture 1 will be described.

The height of the kitchen furniture 1 needs to be provided with dimensions in which the user does not have any inconvenience when standing in front of the furniture 1 to cook food or sitting down to eat food. Also, when the user approaches the under counter type refrigerator to manipulate the door or withdraw food from the inside, it should be provided with dimensions that does not cause inconvenience.

For example, a first height H1 of the furniture body 2 may be defined in a range of about 800 mm to about 900 mm, a second height H2 of the upper plate 3 may be defined in a range of about 40 mm to about 60 mm, and a height of the recess 6 (the wash board) may be defined in a range of about 100 mm to about 150 mm.

The height of each of the under counter type refrigerators 10, 20, and 30 provided in the furniture body 2 may be in the range of the first height H1, and a width W1 of each of the refrigerators 10, 20, and 30 in the horizontal direction may be in a range of about 550 mm to about 600 mm.

As described above, each of the under counter type refrigerators 10, 20, and 30 have a limitation that is designed to be less in size than the general refrigerator.

The refrigerator has to include a refrigeration cycle component for generating cool air, i.e., a machine room equipped with a compressor and a condenser and an evaporator provided at one side of the storage compartment. The machine room and the evaporator are the main components that determine the performance of the refrigerator and need to be provided above a predetermined size. Particularly, when the freezing compartment is provided in the refrigerator, a relatively large evaporator has to be installed when compared to a case in which only the refrigerating compartment is provided.

Due to the limitations in the sizes of the refrigerator and main components, there is a limitation in that the storage compartment of the refrigerator is narrowed. In this embodiment, the above-described limitation may be solved through the configuration of the machine room, the proper arrangement of the evaporator, and the compact design of the heat dissipation passage.

Figure 4:
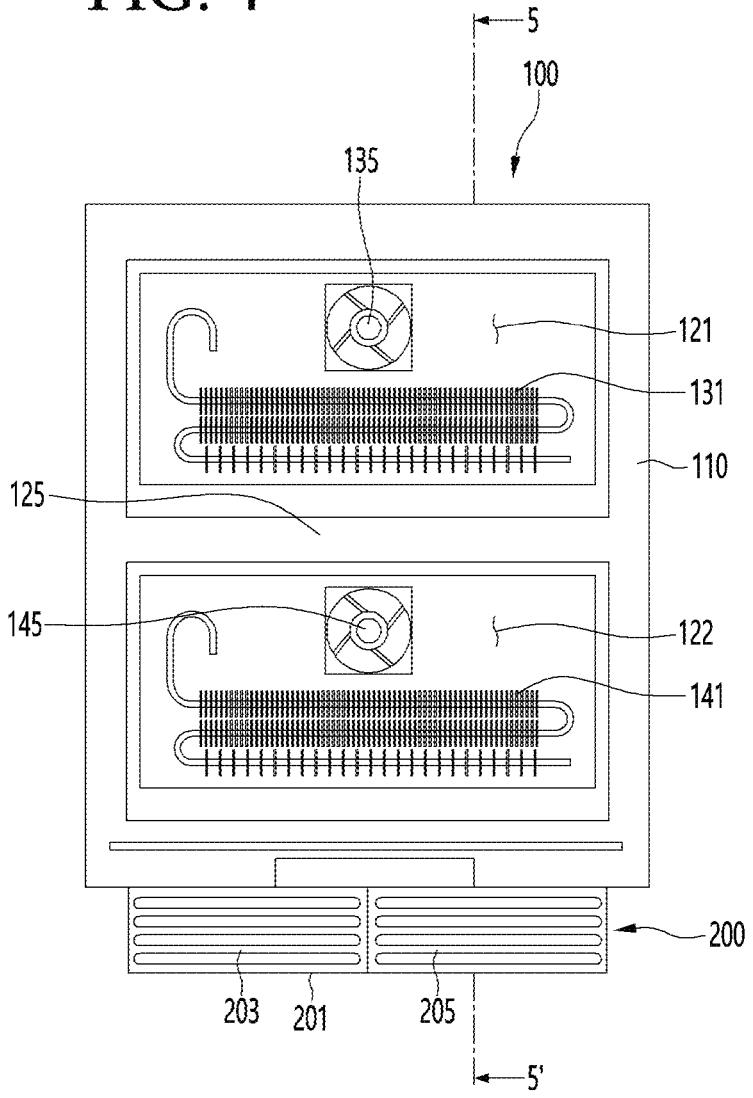
FIG. 4 is a view illustrating an inner storage compartment and an arrangement of components of a refrigeration cycle in a state in which the door of the under counter type refrigerator is opened according to an embodiment.
Figure 5:
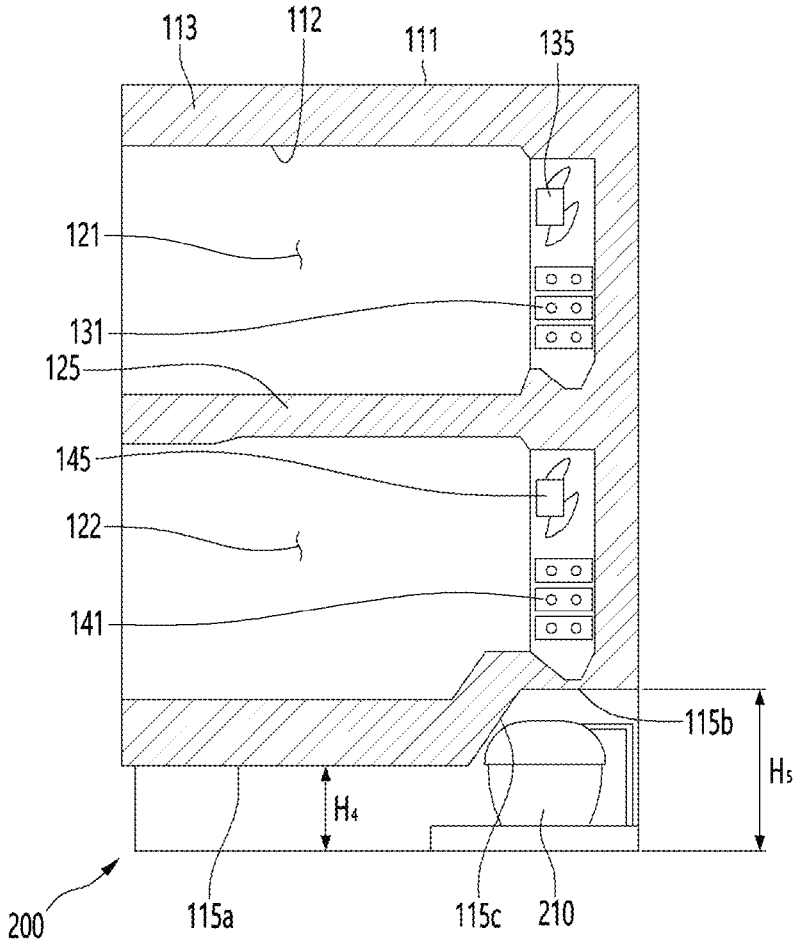
FIG. 5 is a cross-sectional view taken along line 5-5' of FIG. 4.
Figure 6:
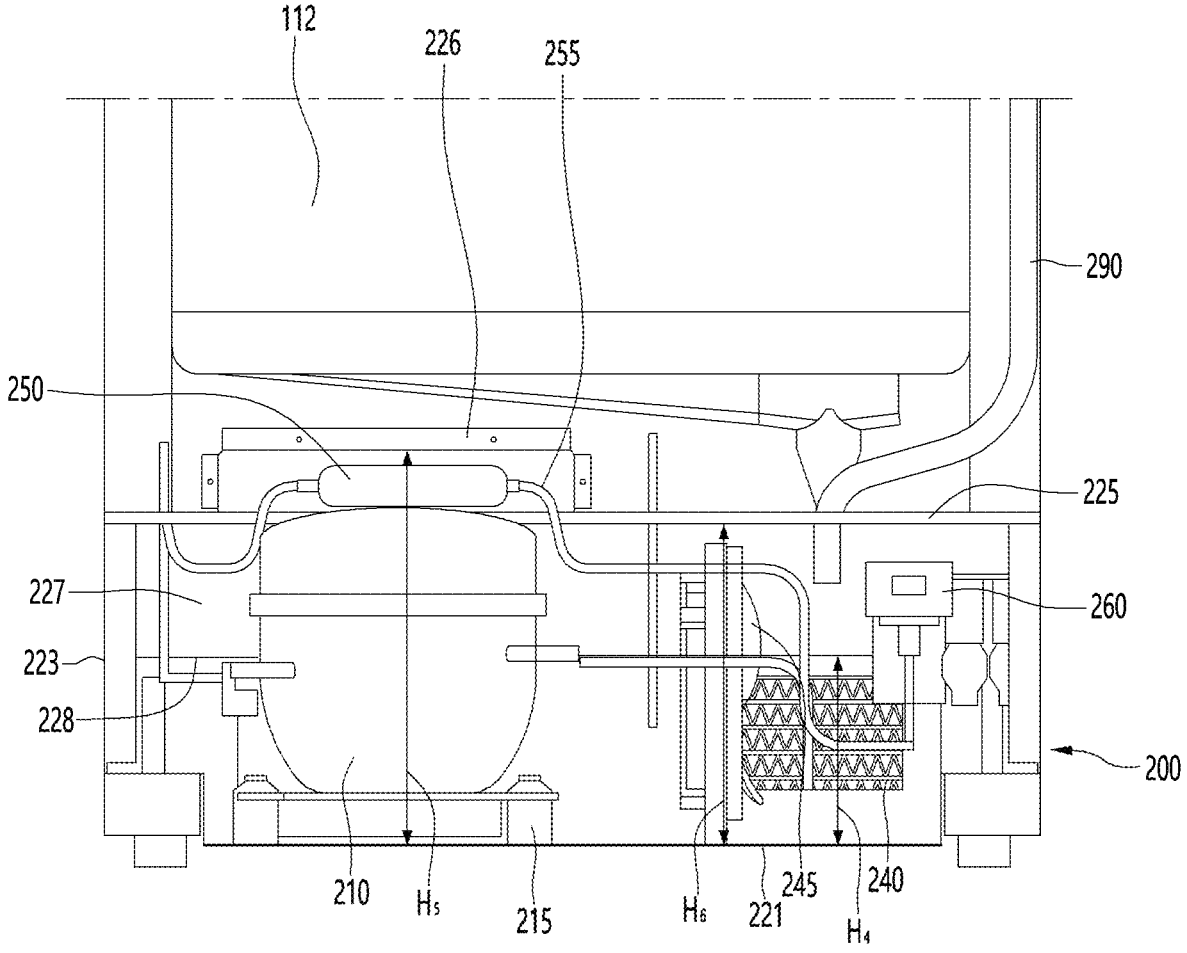
FIG. 6 is a rear view of a machine room in an under counter type refrigerator according to a first embodiment.
Figure 7:
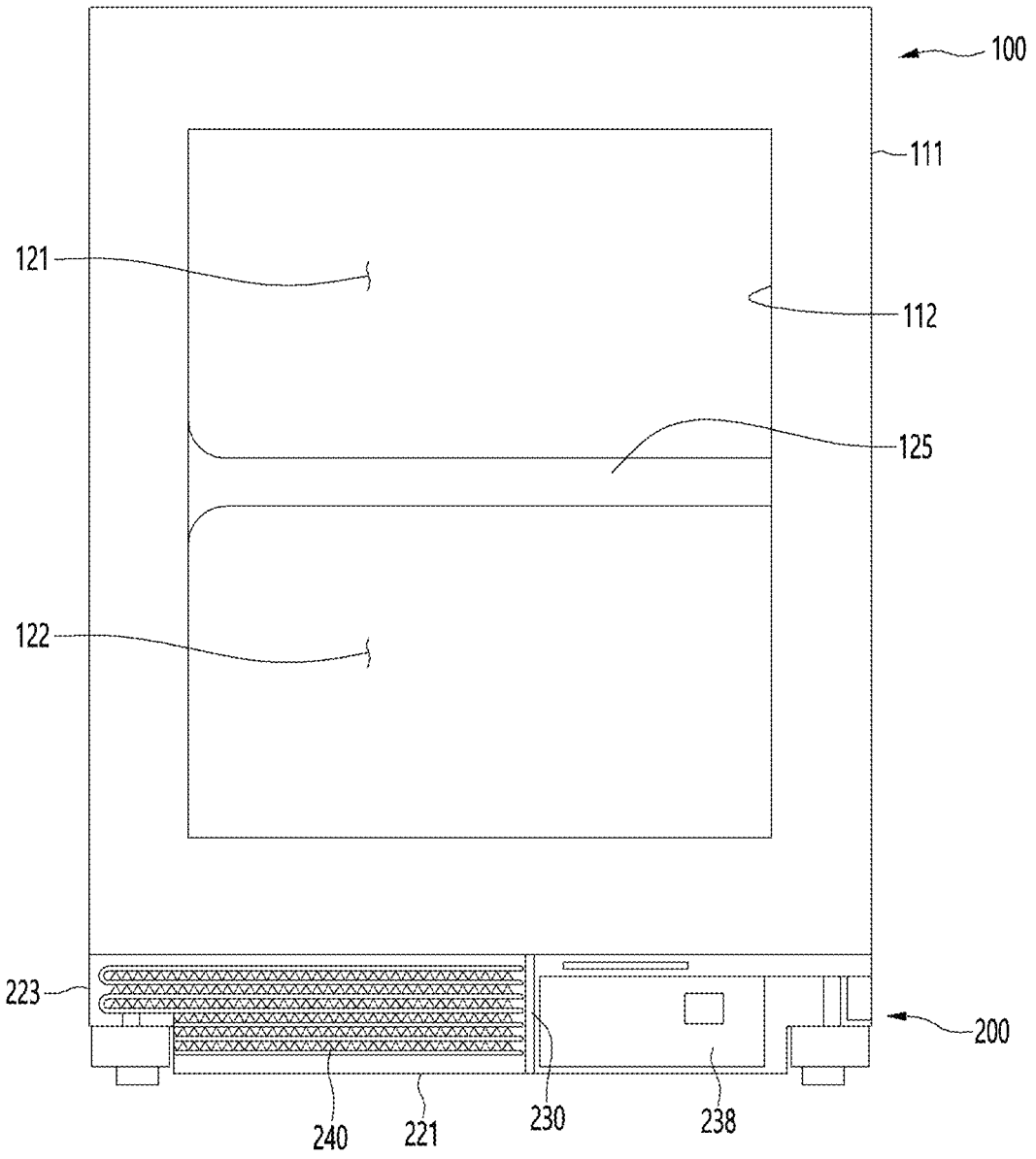
FIG. 7 is a front view illustrating a state in which the machine room is provided in a lower portion of a storage compartment in the under counter type refrigerator according to the first embodiment.

FIG. 4 is a view illustrating the inner storage compartment and an arrangement of components of a refrigeration cycle in the state in which the door of the under counter type refrigerator is opened according to an embodiment, FIG. 5 is a cross-sectional view taken along line 5-5' of FIG. 4, FIG. 6 is a rear view of a machine room in an under counter type refrigerator according to a first embodiment, and FIG. 7 is a front view illustrating a state in which the machine room is provided in a lower portion of a storage compartment in the under counter type refrigerator according to the first embodiment.

Referring to FIGS. 4 to 7, an under counter type refrigerator 100 according to an embodiment includes a main body 110 defining storage compartments 121 and 122. While the embodiment shows storage compartments 121 and 122, in other embodiments, the main body 110 may define one of the storage compartments 121 and 122, or more than two storage compartments. The main body 110 includes an outer case 111 defining an outer wall, an inner case 112 defining inner walls of the storage compartments 121 and 122, and an insulating material provided between the outer case 111 and the inner case 112.

The refrigerator 100 further include a barrier 125 that divides the storage compartments 121 and 122 into a first storage compartment 121 and a second storage compartment 122. For example, the first and second storage compartments 121 and 122 may be divided vertically by the barrier 125.

The first storage compartment 121 and the second storage compartment 122 may implement independent temperatures. That is, types of food stored in the first storage compartment 121 and the second storage compartment 122 may be different.

For example, one of the first and second storage compartments 121 and 122 may be configured as a refrigerating compartment to store food to be refrigerated, and the other may be configured as a freezing compartment to store food to be frozen. In this case, the temperature ranges of the first and second storage compartments 121 and 122 may be defined differently.

For another example, one of the first and second storage compartments 121 and 122 may be configured as a wine storage compartment to store wine, and the other may be configured as a beverage storage compartment to store beverages. In this case, the temperature ranges of the first and second storage compartments 121 and 122 may be defined differently.

Of course, the first and second storage compartments 121 and 122 may have the same temperature range to store the same kind of food.

The refrigerator 100 may further include a refrigeration cycle component that supplies cool air to the first and second storage compartments 121 and 122.

In detail, the refrigerator 100 further includes a first evaporator 131 and a first evaporation fan 135, which are installed at a rear wall of the first storage compartment 121, that is, in front of a rear side of the inner case 112. The first evaporation fan 135 may be disposed above the first evaporator 131.

When the first evaporation fan 135 is driven, the cool air of the first storage compartment 121 may be cooled through the first evaporator 131 and then be supplied again to the first storage compartment 121 through the first evaporation fan 135.

The refrigerator 100 further includes a second evaporator 141 and a second evaporation fan 145, which are installed at a rear wall of the second storage compartment 122, that is, in front of a rear side of the inner case 112. The second evaporation fan 145 may be disposed above the second evaporator 141.

When the second evaporation fan 145 is driven, the cool air of the second storage compartment 122 may be cooled through the second evaporator 141 and then be supplied again to the second storage compartment 122 through the second evaporation fan 145.

Although not illustrated in FIG. 4, a first evaporator cover for shielding the first evaporator 131 may be provided in front of the first evaporator 131, and the second evaporator cover for shielding the second evaporator 141 may be provided in front of the second evaporator 141.

The refrigerator 100 is provided under the main body 110 and further includes a machine room 200 in which a compressor 210 and a condenser 240 are installed.

The machine room 200 may be defined from a lower front end to a rear end of the refrigerator 100. Bottom surfaces 115*a* and 115*b* of the main body 110 may define an upper end of the machine room 200.

The bottom surfaces 115*a* and 115*b* of the main body 110 include a first bottom surface 115*a* defined on a front upper end of the machine room 200 and a second bottom surface 115*b* defined on a rear upper end of the machine room 200. The second bottom surface 115*b* is defined behind the first bottom surface 115*a*.

A heat dissipation passage through which air flows may be provided between the first bottom surface 115*a* and the lower end of the machine room 200.

A compressor 210 may be installed between the second bottom surface 115*b* and the lower end of the machine room 200. The compressor 210 may be installed on a lower plate 221, and a support damper 215 may be provided on a lower portion of the compressor 210 to reduce an intensity at which vibration generated by the compressor 210 is transmitted to the lower plate 221.

Since the compressor 210 has to be disposed at a predetermined height or more in its structure, a distance between the second bottom surface 115*b* and the lower end of the machine room 200 is relatively large.

In detail, a height H5 from the lower end of the machine room 200 to the second bottom surface 115*b* may be greater than a height H4 from the lower end of the machine room 200 to the first bottom surface 115*a*. Thus, the second bottom surface 115*b* may be disposed at a position that is higher than the first bottom portion 115*a*.

The bottom surface of the main body 110 further includes a third bottom surface 115*c* extending to be inclined upward from the first bottom surface 115*a* toward the second bottom surface 115*b*.

The front surface of the machine room 200 may define a front portion of the refrigerator 100. Air may be suctioned from the front side of the machine room 200 and then pass through the heat dissipation passage. Then, the air may be discharged to the front side of the machine room 200.

A front grill 201 through which air passes is provided in the front surface of the machine room 200. The front grill 201 includes a suction grill 203 as a "suction portion" for suctioning air and a discharge grill 205 as a "discharge portion" for discharging air. The suction grill 203 and the discharge grill 205 may be disposed at left and right sides.

The lower cover 7 described with reference to FIG. 3 may be provided in front of the front grill 201.

A number of components for driving the refrigeration cycle may be installed inside the machine room 200. The plurality of components include the compressor 210 compressing a refrigerant, the condenser 240 condensing the refrigerant compressed in the compressor 210, and a condensation fan 245 that forces a flow of air so as to suction or discharge the refrigerant through the suction grill 203 and the discharge grill 205.

The plurality of components further include a valve 260 that distributes the refrigerant condensed in the condenser 240 to the first evaporator 131 and the second evaporator 141. The valve 260 includes a three-way valve.

The inner space of the machine room 200 may be defined by a number of plates. The plurality of plates include a lower plate that defines a bottom surface of the machine room 200 and provides an installation surface on which the plurality of components are installed.

The plurality of plates further include two side plates 223 extending upward from both sides of the lower plate 221. The two side plates 223 include a first side plate 223*a* and a second side plate 223*b* (see FIG. 10).

The plurality of plates further include a first upper plate 225 provided above the condensation fan 245. The first upper plate 225 may be disposed at a position that is slightly higher than an upper end of the condensation fan 245 and may be configured to cover the condensation fan 245. Also, the first upper plate 225 may extend parallel to the lower plate 221 by a predetermined length forward.

The plurality of plates further include a second upper plate 226 provided above the compressor 210. The upper end of the compressor 210 may have a height that is higher than that of the upper end of the condensation fan 245. Thus, the second upper plate 226 may be disposed at a position that is higher than the first upper plate 225. Also, the second upper plate 226 may extend parallel to the lower plate 221 by a predetermined length forward.

The second upper plate 226 may be understood to define a surface corresponding to the second bottom surface 115*b* of the main body 110. Thus, a distance from the lower plate 221 to the second upper plate 226 may be defined as a height H5.

The plurality of plates further include an inclined plate 227 extending downward inclined from the first upper plate 225 and the second upper plate 226 in a forward direction. The inclined plate 227 may be understood to define a surface corresponding to the third bottom surface 115*c* of the main body 110.

The plurality of plates further include a front plate 228 extending forward from a lower end of the inclined plate 227. The front plate 228 may extend parallel to the lower plate 221.

The front plate 228 may be understood to define a surface corresponding to the first bottom surface 115*a* of the body 110. Accordingly, a distance H4 from the lower plate 221 to the front plate 228 may be defined as a height H4.

A distance from the lower plate 221 to the first upper plate 225 may be defined as a height H6. The height H6 may be greater than the height H4 and less than the height H5.

The first upper plate 225 is disposed to cover an upper side of each of the condensation fan 245 and the valve 260. The second plate 226 is disposed to cover an upper side of the compressor 210.

A dryer 250 that removes moisture or foreign substances from the condensed refrigerant may be provided between the upper end of the compressor 210 and the second plate 226. The dryer 250 may include a dryer body that is provided at a position higher than the first upper plate 225 to extend in the horizontal direction.

The components of the refrigeration cycle, which are disposed in the machine room 200, i.e., the compressor 210, the condenser 240, and the dryer 250 are connected by a refrigerant pipe 255 to guide refrigerant circulation in the components through the refrigerant pipe 255.

The refrigerator 100 further includes a drain pipe 290 that guides defrosting water or condensed water generated in the evaporators 131 and 141 to the inside of the machine room 200. A tray (not shown) that collects the defrosting water or condensed water may be provided under each of the evaporators 131 and 141, and the drain pipe 290 may be coupled to the tray to extend downward.

The drain pipe 290 may extend into an inner space of the machine room 200. The drain pipe 290 may be fixed by passing through any one of the plurality of plates.

For example, the drain pipe 290 may extend downward through the first upper plate 225. However, the penetration position of the drain pipe 290 is not limited thereto and may be arranged to pass through the inclined plate 227 or the front plate 228.

The inner space of the machine room 200 may be configured to be divided into a first space and a second space by a guide wall 230. The first and second spaces may be arranged at left and right sides.

In detail, referring to FIG. 7, when the refrigerator 100 is viewed from the front side, the machine room 200 may be divided into the left and right sides with respect to the guide wall 230, and the condenser 240 may be disposed in the first space corresponding to the left side. Also, a control box 238 may be disposed in the second space corresponding to the right side.

The control box 238 includes control components that control an operation of the refrigerator 100.

The air outside the refrigerator 100 is introduced into the first space from the front side of the refrigerator 100 to cool the condenser 240. Also, the air flows backward to cool the compressor 210 while passing through the compressor 210 via the condensation fan 245.

Thereafter, the air may pass through the control box 238 disposed in front of the compressor 210 to cool the control box 238 and then be discharged to the front side of the refrigerator 100.

The condensation fan 245 may be installed on the guide wall 230, the condenser 240 may be disposed in the first space, and the compressor 210 and the control box 238 may be disposed in the second space.

Figure 8:
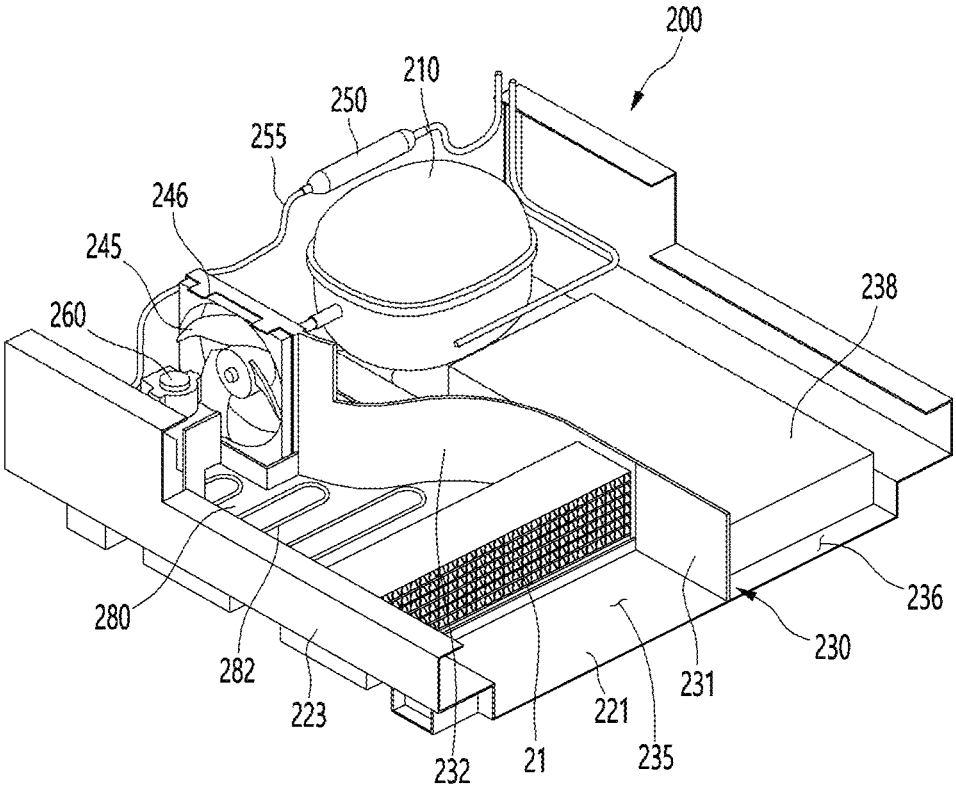
FIG. 8 is a front perspective view illustrating constituents of the machine room according to the first embodiment.
Figure 9:
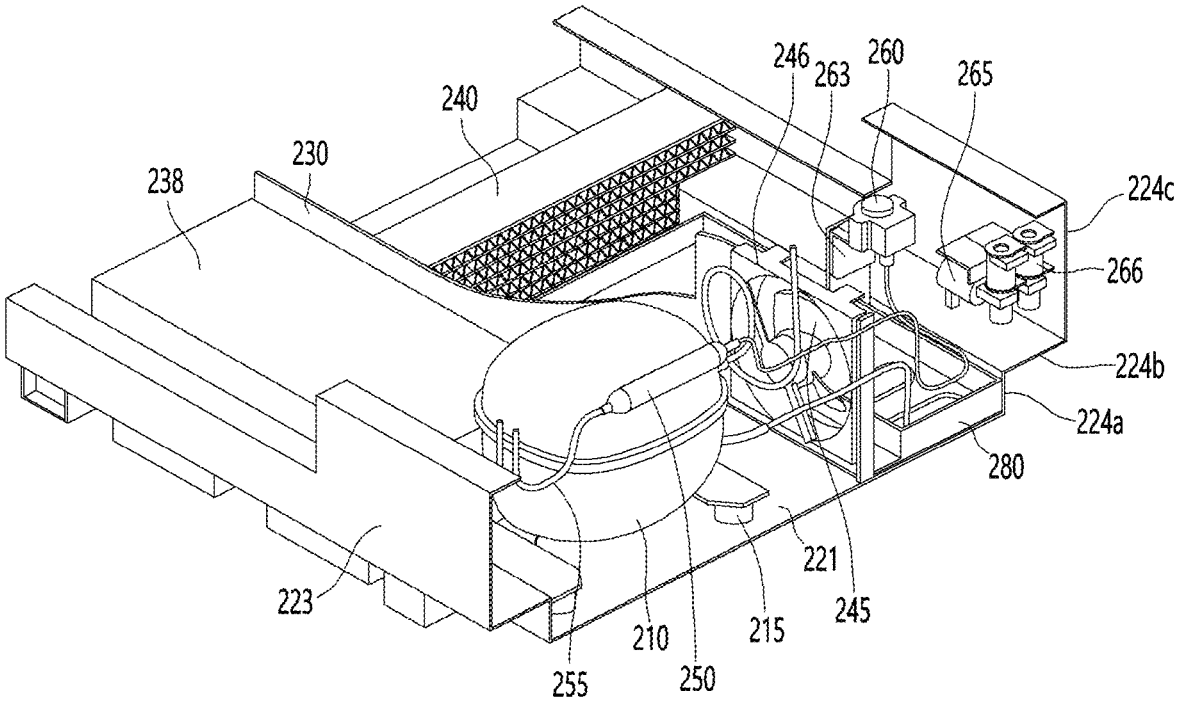
FIG. 9 is a rear perspective view illustrating the constituents of the machine room according to the first embodiment.
Figure 10:
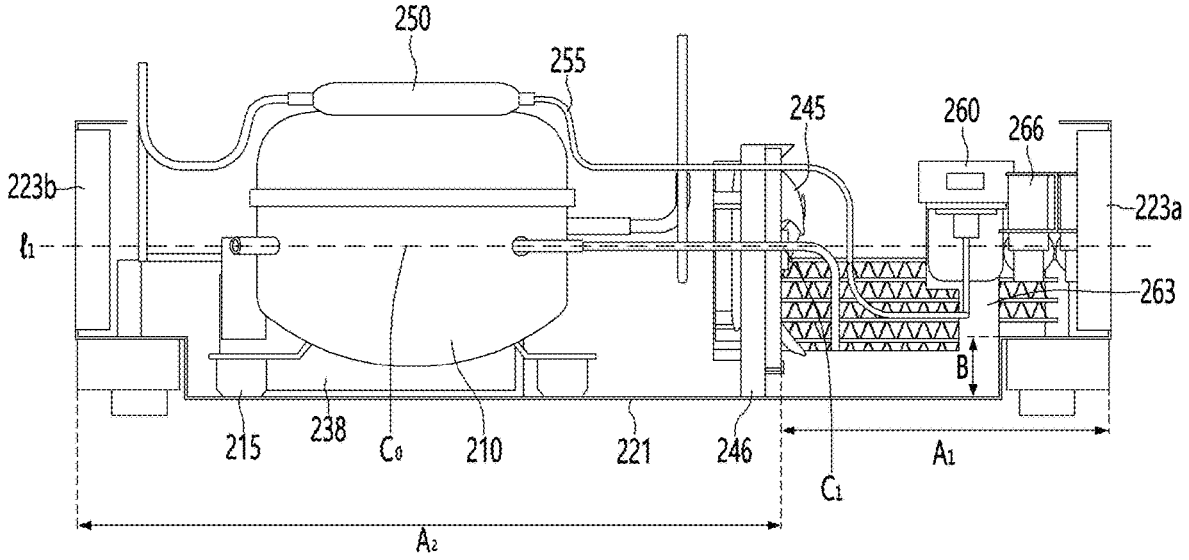
FIG. 10 is a rear view illustrating the constituents of the machine room according to the first embodiment.
Figure 11:
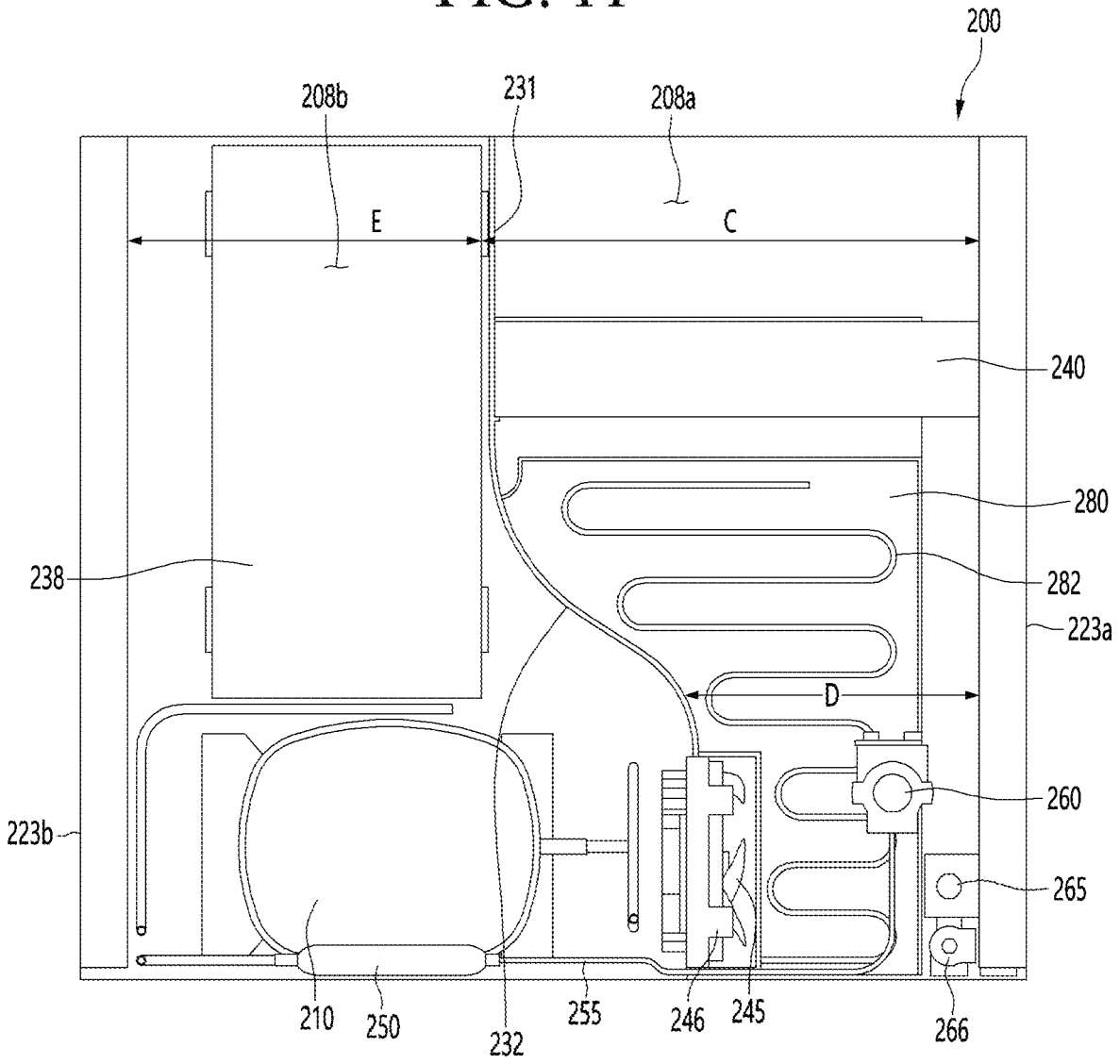
FIG. 11 is a plan view illustrating the constituents of the machine room according to the first embodiment.

FIG. 8 is a front perspective view illustrating constituents of the machine room according to the first embodiment, FIG. 9 is a rear perspective view illustrating the constituents of the machine room according to the first embodiment, FIG. 10 is a rear view illustrating the constituents of the machine room according to the first embodiment, and FIG. 11 is a plan view illustrating the constituents of the machine room according to the first embodiment.

Referring to FIGS. 8 to 11, the machine room 200 according to an embodiment includes a lower plate 221 and a side plate 223, which define an installation space of the components of the refrigeration cycle.

The machine room 200 includes a guide wall 230 that divides the installation space. The guide wall 230 may extend backward from a front portion of the machine room 200 through which air is suctioned and discharged.

The guide wall 230 protrudes upward from the lower plate 221 to divide the installation space into a first space 235 and a second space 236. The first space 235 defines a suction passage 208*a* as a suction-side space of the condensation fan 245, and the second space 236 defines a discharge passage 208*b* as a discharge-side space of the condensation fan 245.

The condenser 240 and the valve 260 may be installed in the first space 235. The condenser 240 may be disposed in a front portion of the first space 235, and the valve 260 may be disposed in a rear portion of the first space 235. Also, the valve 260 may be disposed at an outlet-side of the condenser 240 based on an air flow.

A compressor 210 and a control box 238 may be disposed in the second space 236. The control box 238 may be disposed in a front portion of the second space 236 and the compressor 210 in a rear portion of the second space 236. Also, the control box 238 may be disposed at an outlet-side of the compressor 210 based on the air flow.

Since the first and second spaces 235 and 236 are divided into left and right sides so as to be lengthily defined from the front end to the rear end of the refrigerator 100, and the components of the refrigeration cycle may be installed at the left and right sides to reduce a height of the machine room 200.

Each of the storage compartments 121 and 122 may significantly increase in volume by the reduced height of the machine room 200, and each of the evaporators 131 and 141 provided on the rear walls of the storage compartments 121 and 122 may significantly increase in size. Particularly, the evaporator for driving the freezing compartment needs to be provided to be relatively large so as to increase in heat evaporation amount. Since a compact machine room 200 is implemented, the installation of a relatively large evaporator of the freezing compartment may be facilitated.

A left and right width of the first space 235 may be defined to decrease towards the rear side of the machine room 200. For this, the guide wall 230 may be rounded or inclined towards the rear side.

In detail, the guide wall 230 includes a first part 231 linearly extending backward from the front end of the machine room 200 and a second part 232 extending to be rounded or inclined from the first part 231 so as to reduce a left and right width of the first space 235.

The condenser 240 may be disposed at one side, and the control box 238 may be disposed at the other side with respect to the first part 231.

A left and right width C of the first space 235 may be greater than the left and right width E of the second space 236 with respect to the first part 231. Also, the condenser 240 may be provided in the first space 235 defined at a side of the first part 231.

That is, since the left and right width of a front portion of the first space 235 in which the condenser 240 is provided is relatively large with respect to the first part 231, a size of the condenser 240 may be relatively large. Thus, heat dissipation performance of the refrigeration cycle may be improved.

An opposite side of the condenser 240, i.e., a left and right width of a front portion of the second space 236 with respect to the first part 231 may be relatively small in which the control box 238 that is easy to be manufactured by relatively reducing the width is installed.

The condenser 240 may be provided as a microchannel flat tube type heat exchanger (MF heat exchanger). The MF heat exchanger has a compact configuration and has an advantage of having excellent efficiency.

The second part 232 may extend backward from the outlet side of the condenser 240 based on the air flow. The rear portion of the first space 235 may have a relatively small width by the rounded or inclined configuration of the second part 232.

The width of the front portion of the first space 235, i.e., the left and right width C of the first space 235 with respect to the first part 231 may be greater than the width of the rear portion, i.e., the left and right width D of the first space 235 with respect to the second part 232.

Thus, a flow rate of air passing through the condenser 240 may increase and be suctioned into the condensation fan 245.

The rear portion of the second space 236 may have a relatively large width due to the configuration of the second part 232. That is, the installation space of the components may be secured significantly. The compressor 210 having a relatively large size may be easily installed in the rear portion of the second space 236.

A defrosting water tray 280 is installed under the first space 235. In the defrosting water tray 280, water discharged from the drain pipe 290 may drop into the defrosting water tray 280 to be stored. The defrosting water tray 280 may correspond to a shape of the guide wall 230 and be configured to be reduced in cross-sectional area towards the rear side. In other words, a cross-sectional area of a rear portion of the defroster tray 280 may be less than that of a cross-sectional area of its front portion.

The defrosting water tray 280 is provided with a tray pipe 282 that provides heat for evaporating the defrosting water. The tray pipe 282 may be placed on a top surface of the defrosting water tray 280. A high-temperature refrigerant compressed by the compressor 210 flows through the tray pipe 282 to assist in the evaporation of the defrosting water. Since the condenser 240 is provided at an outlet-side of the tray pipe 282, the refrigerant flowing through the tray pipe 282 may be introduced into the condenser 240 and then be condensed.

A fan shroud 246 is provided at a rear side of the guide wall 230. In another aspect, the fan shroud 246 may be provided at a rear portion of the guide wall 230.

The condensation fan 245 is installed in the fan shroud 246. The condensation fan 245 may rotate inside the fan shroud 246 to generate an air flow.

A valve 260, a water pump 265, and a water valve 266 may be provided in the rear portion of the first space 235.

The refrigerator 100 may include an ice maker. The ice maker may be provided in a storage compartment defined as the freezing compartment of the storage compartments 121 and 122. The water pump 265 and the water valve 266 may be understood as devices for supplying water to the ice maker.

The water pump 265 and the water valve 266 may be installed on a first side plate 223*a*.

In detail, the first side plate 223*a* includes a first plate part 224*a* extending upward from the lower plate 221 to contact or be adjacent to a side surface of the defrosting water tray 280, a second plate part 224*b* extending outward laterally from the first plate part 224*a*, and a third plate part 224*c* extending upward from the second plate part 224*b*.

A predetermined installation space may be provided in the first space 235 by the second and third plates 224*b* and 224*c*, and the water pump 265 and the water valve 266 may be disposed in the installation space.

The water pump 265 and the water valve 266 may be coupled to the second plate part 224*b* or the third plate part 224*c* by a bracket.

The valve 260 may be supported on the defrosting water tray 280. In detail, a valve bracket 263 may be provided above the defrosting water tray 280. The valve bracket 263 may extend upward from an upper end of the defrosting water tray 280 and be coupled to the valve 260.

Referring to FIG. 10, a distance A2 between the second side plate 223*b* defining the second space 236 and the condensation fan 245 may be greater than a distance A1 between the first side plate 223*a* defining the first space 235 and the condensation fan 245.

That is, the left and right widths A2 of the second space 236 may be greater than the left and right widths A1 of the first space 235 with respect to the condensation fan 245. Thus, the installation space of the compressor 210 may be sufficiently provided at the rear portion of the second space 236.

The first space 235 provides a suction-side passage of the condensation fan 245, and the second space 236 provides a discharge-side passage of the condensation fan 245.

To provide a sufficient size of the heat dissipation passage, the suction-side passage of the condensation fan 245 needs to be provided to a predetermined size or more. For example, the left and right width A1 of the first space 235 may be defined in a range of about 180 mm to about 200 mm.

To secure a water collection capacity of the defrosting water tray 280, a height B of the defrosting water tray 280 needs to be provided to a predetermined height or more. For example, the height of the defrosting water tray 280 may be defined in a range of about 25 mm to about 30 mm.

The condensation fan 245 may be disposed to be spaced a predetermined height upward from the lower plate 221. For example, a lower end of the condensation fan 245 may be disposed at a position corresponding to an upper end of the defrosting water tray 280. Thus, a phenomenon in which the air flow is disturbed by the defrosting water existing in the defrosting water tray 280 may be prevented from occurring.

A first center Co of the compressor 210 in the vertical direction and a second center C1 of the condensation fan 245 in the vertical direction may be defined at the same height. That is, an extension line L1 connecting the first center Co to the second center C1 may be parallel to the lower plate 221. Due to the arrangement of the compressor 210 and the condensation fan 245, air discharged from the condensation fan 245 may easily cool the compressor 210.

Figure 12:
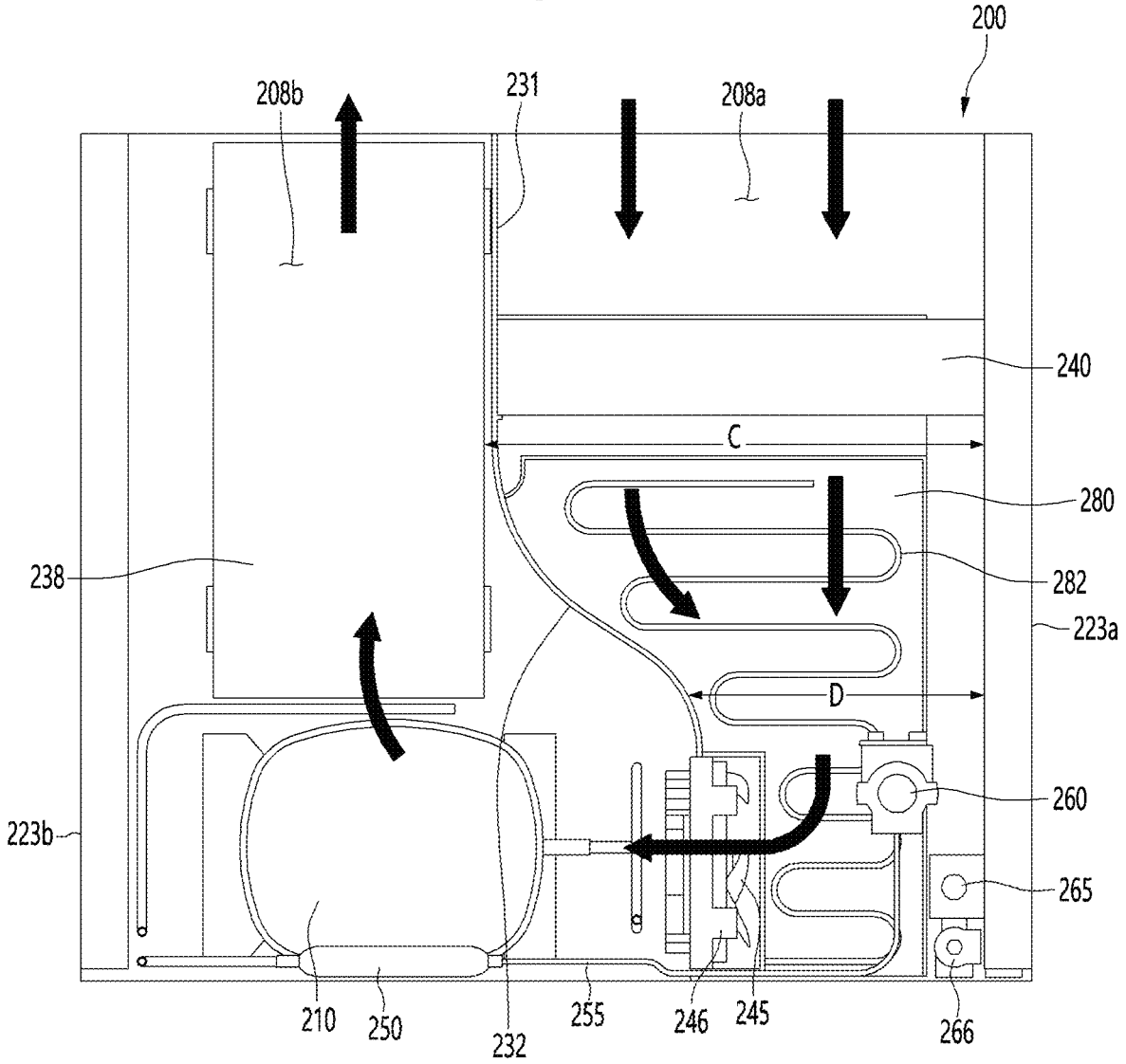
FIG. 12 is a view illustrating a state in which air in the machine room flows according to the first embodiment.

FIG. 12 is a view illustrating a state in which air in the machine room flows according to the first embodiment.

Referring to FIG. 12, the heat dissipation passage through which air flows through the machine room 200 will be described. When the condensation fan 245 is driven, air outside the refrigerator is introduced into the first space 235 from the front side through the suction grill 203.

The air introduced into the first space 235 flows towards the back, passes through the condenser 240, and passes through an upper space of the defrosting water tray 280 to assist in the evaporation of the defrosting water.

The air may be suctioned into the condensation fan 245 and be switched laterally from the first space 235 towards the second space 236. The air discharged from the condensation fan 245 may cool the compressor 210 while passing through the compressor 210.

The air passing through the compressor 210 flows to the front side to cool the control box 238 while passing through the control box 238 disposed in front of the compressor 210.

The air passing through the control box 238 flows forward and be discharged to the front side of the refrigerator through the discharge grill 205.

A refrigerant flow will be described below.

The high-temperature refrigerant compressed by the compressor 210 flows through the tray pipe 282 to assist in the evaporation of the defrosting water stored in the defrosting water tray 280.

The refrigerant passing through the tray pipe 282 may be introduced into the condenser 240 and condensed, and then, moisture or foreign substances may be separated from the refrigerant while the refrigerant passes through the dryer 250.

The refrigerant passing through the dryer 250 flows into the valve 260 and is branched from the valve 260 to flow towards the first and second evaporators 231 and 241. A capillary (not shown) may be provided at an inlet-side of each of the first and second evaporators 231 and 241, and the refrigerant may be decompressed in the capillary, and then be introduced into the first and second evaporators 231 and 241 and be evaporated.

The refrigerant evaporated in the first and second evaporators 231 and 241 may be suctioned again into the compressor 210, and thus, the circulation described above may be repeated.

Figure 13:
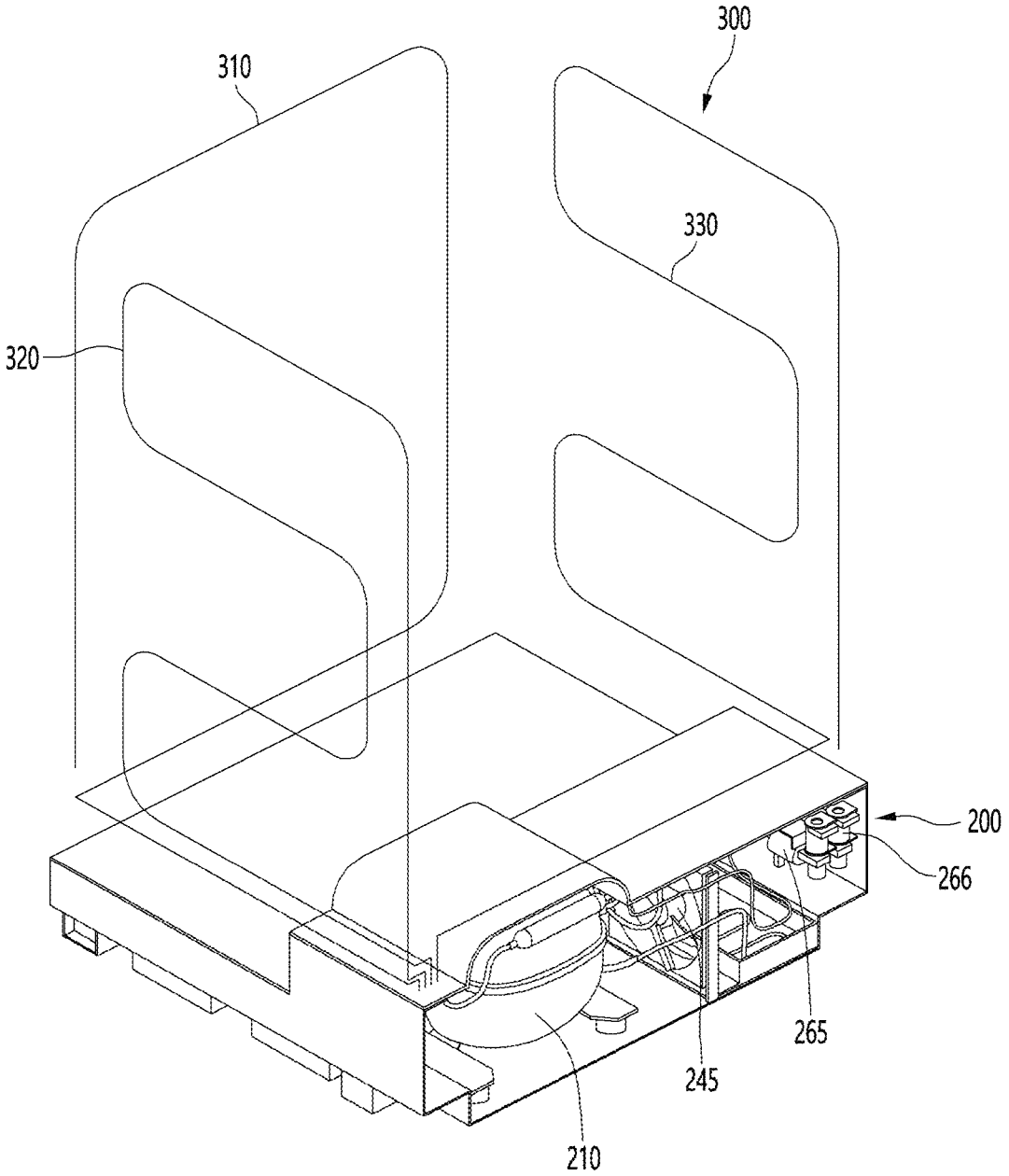
FIG. 13 is a schematic view illustrating a configuration of a wall condenser provided with a front surface and a side surface of the under counter type refrigerator according to the first embodiment.
Figure 14:
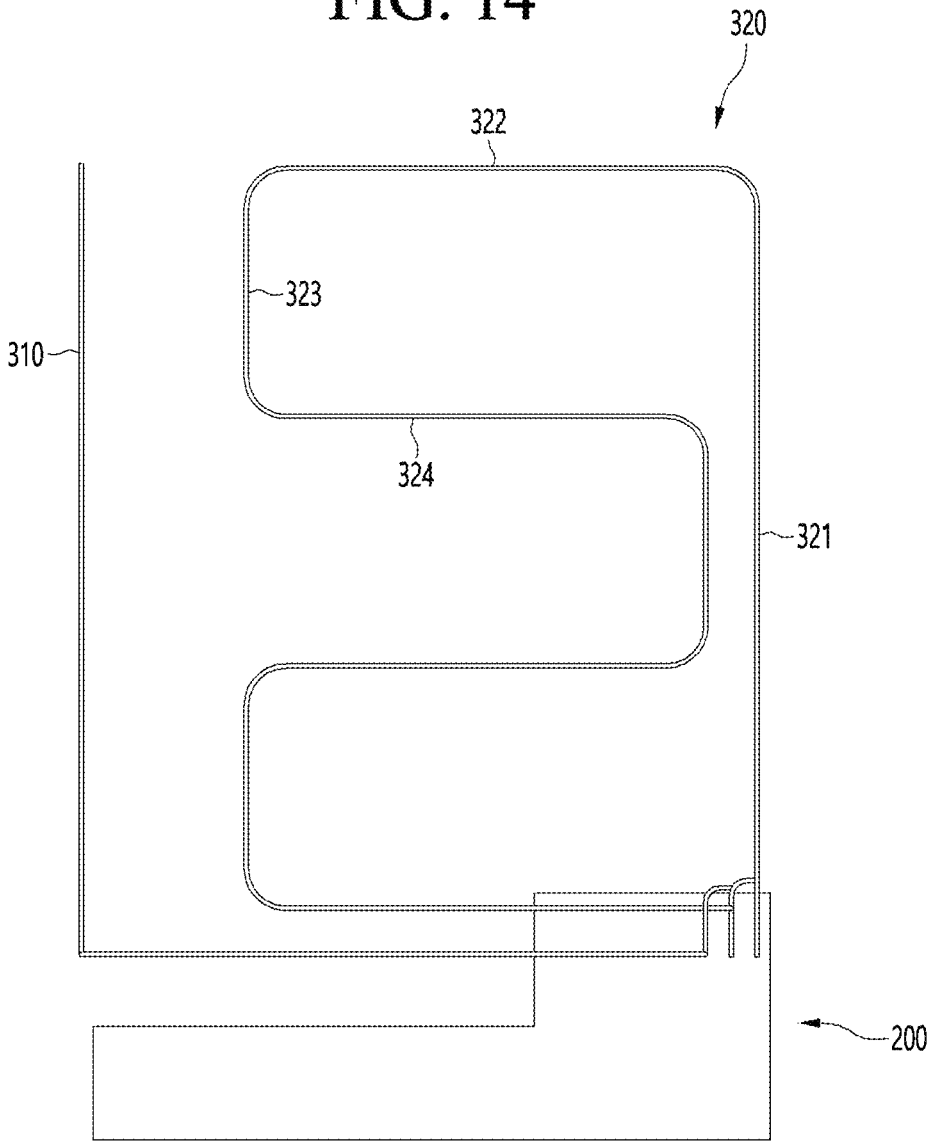
FIG. 14 is a side view illustrating the configuration of the wall condenser provided with the front surface and the side surface of the under counter type refrigerator according to the first embodiment.
Figure 15:
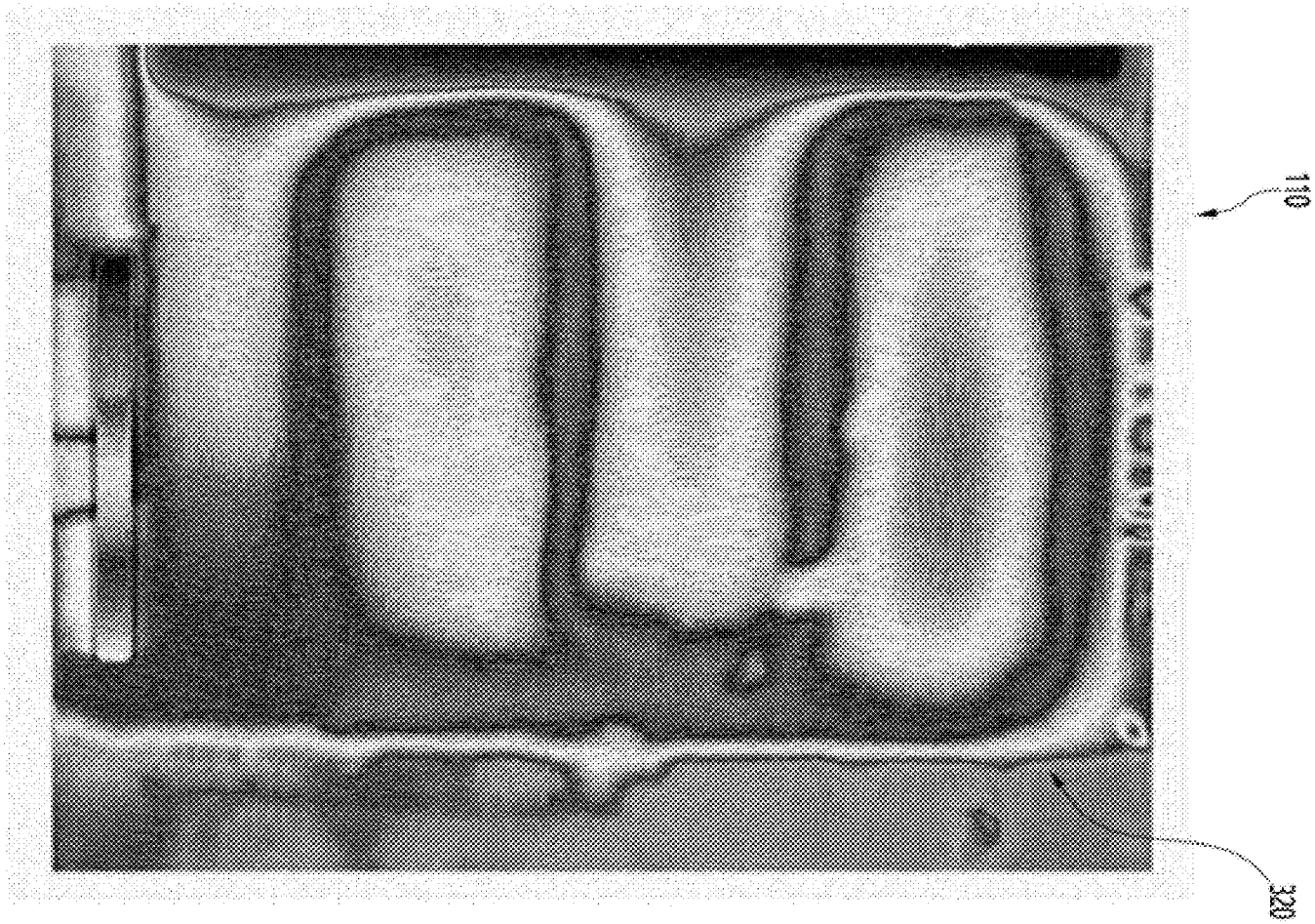
FIG. 15 is a simulation diagram illustrating a state in which a temperature of a sidewall of the refrigerator rises above a dew point temperature when the wall condenser is installed.

FIG. 13 is a schematic view illustrating a configuration of a wall condenser provided with a front surface and a side surface of the under counter type refrigerator according to the first embodiment, FIG. 14 is a side view illustrating the configuration of the wall condenser provided with the front surface and the side surface of the under counter type refrigerator according to the first embodiment, and FIG. 15 is a simulation diagram illustrating a state in which a temperature of a sidewall of the refrigerator rises above a dew point temperature when the wall condenser is installed.

Referring to FIGS. 13 and 14, the under counter type refrigerator 100 further includes a wall condenser 300. A plurality of under counter type refrigerators 100 may be arranged side by side in the horizontal direction so as to be adjacent to the furniture 1, and when a temperature of an outer wall of the refrigerator has a low temperature below a dew point temperature due to an influence of the adjacent refrigerator, dew may be generated on a surface of the refrigerator.

Thus, in this embodiment, the wall condenser 300 through which a high-temperature refrigerant flows may be installed on a sidewall of the refrigerator 100 to prevent dew from being generated on the surface of the refrigerator.

The wall condenser 300 may be configured to be embedded in the insulating material 113 between the outer case 111 and the inner case 112. The refrigerant condensed in the condenser 240 may be introduced into the wall condenser 300, and the refrigerant passing through the wall condenser 300 may flow to the dryer 250.

The wall condenser 300 includes a first condensation portion 310 provided on a front edge of the main body 110, a second condensation portion 320 provided on one sidewall of the main body 110, and a third condensation portion 330 disposed on the other sidewall.

The first condensation portion 310 may be disposed at a position corresponding to a gasket provided on a rear surface of the refrigerator door.

The first to third condensation portions 310, 320, and 330 may be connected to allow the refrigerant to continuously flow. For example, the refrigerant may sequentially flow through the first condensation portion 310, the second condensation portion 320, and the third condensation portion 330.

The second condensation portion 320 may be bent while extending so as to act on a wide area of the sidewall of the body 110. In detail, the second condensation portion 320 includes a first part 321 extending in the vertical direction at the rear side of the main body 110, a second part 322 extending forward from an upper portion of the first part 321, a third part 323 extending downward from the second part 322, and a fourth part 324 extending backward from the third part 323.

For example, the first part 321 may have a length in a range of about 570 mm to about 590 mm, the second part 322 may have a length in a range of about 390 mm to about 410 mm, the third part 323 may have a length in a range of about 190 mm to about 200 mm, and the fourth part 324 may have a length in a range of about 350 mm to about 370 mm.

Also, the second to fourth parts 322, 323, and 324 may be configured to be symmetrical to each other in the vertical direction with respect to a center of the first part 321 in the vertical direction. That is, the second to fourth parts 322, 323, and 324 may be provided at upper and lower portions of the second condensation portion 320, respectively.

Since the third condensation portion 330 has the same shape as the second condensation portion 320, the description of the third condensation portion 330 will be from the same or similar to the above description.

Due to such a configuration, when the refrigerant flows in the wall condenser 300, the sidewall of the refrigerator body 110 may be maintained above the dew point temperature. Referring to FIG. 15, the sidewall of the main body 110 may have a temperature above the dew point temperature in an area on which the wall capacitor 300 is disposed. Thus, the generation of the dew on the outer wall of the refrigerator may be prevented.

Hereinafter, in the under counter type refrigerator according to an embodiment, a configuration of the machine room according to a second embodiment will be described. Since the machine room according to this embodiment is the same as the machine room according to the first embodiment except for portions of the constitutions, differences between the first and second embodiments will be described principally, and descriptions of the same portions may be denoted by the same reference numerals and descriptions of the first embodiment.

Figure 16:
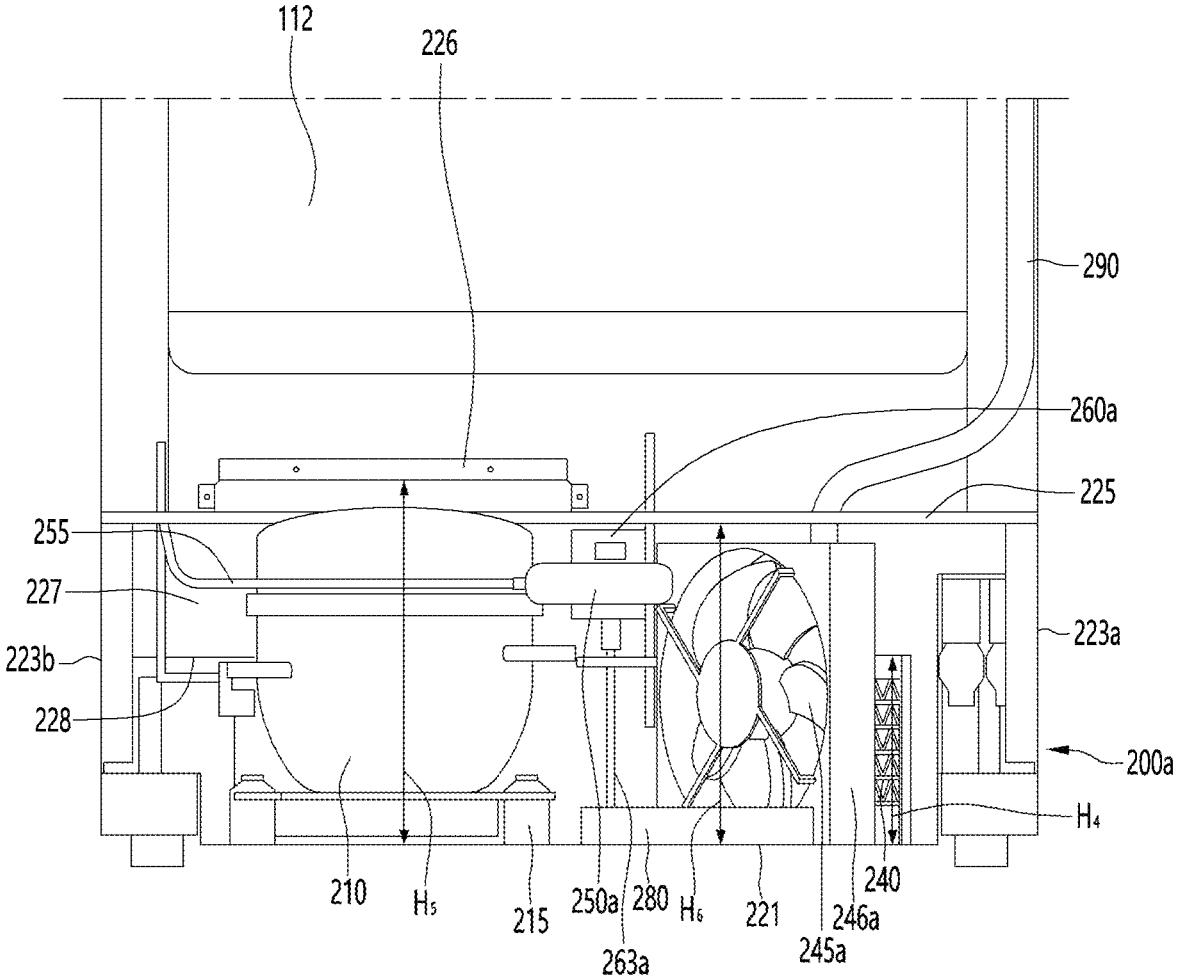
FIG. 16 is a rear view of a machine room in an under counter type refrigerator according to a second embodiment.
Figure 17:
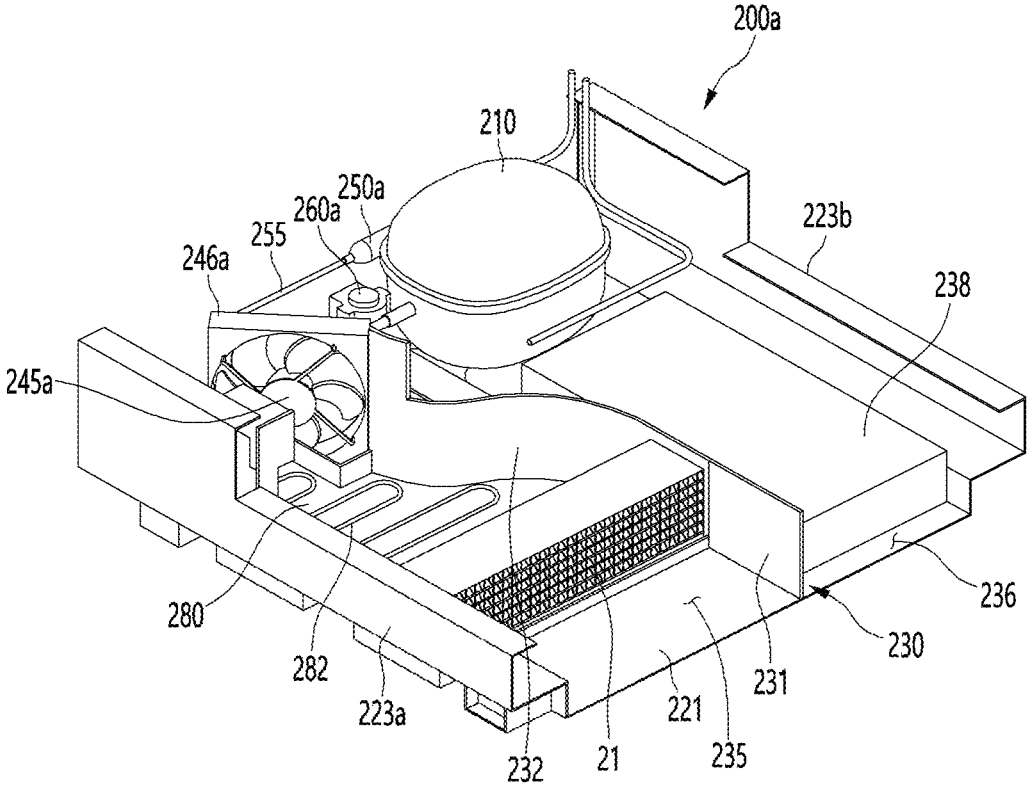
FIG. 17 is a front perspective view illustrating constituents of the machine room according to the second embodiment.
Figure 18:
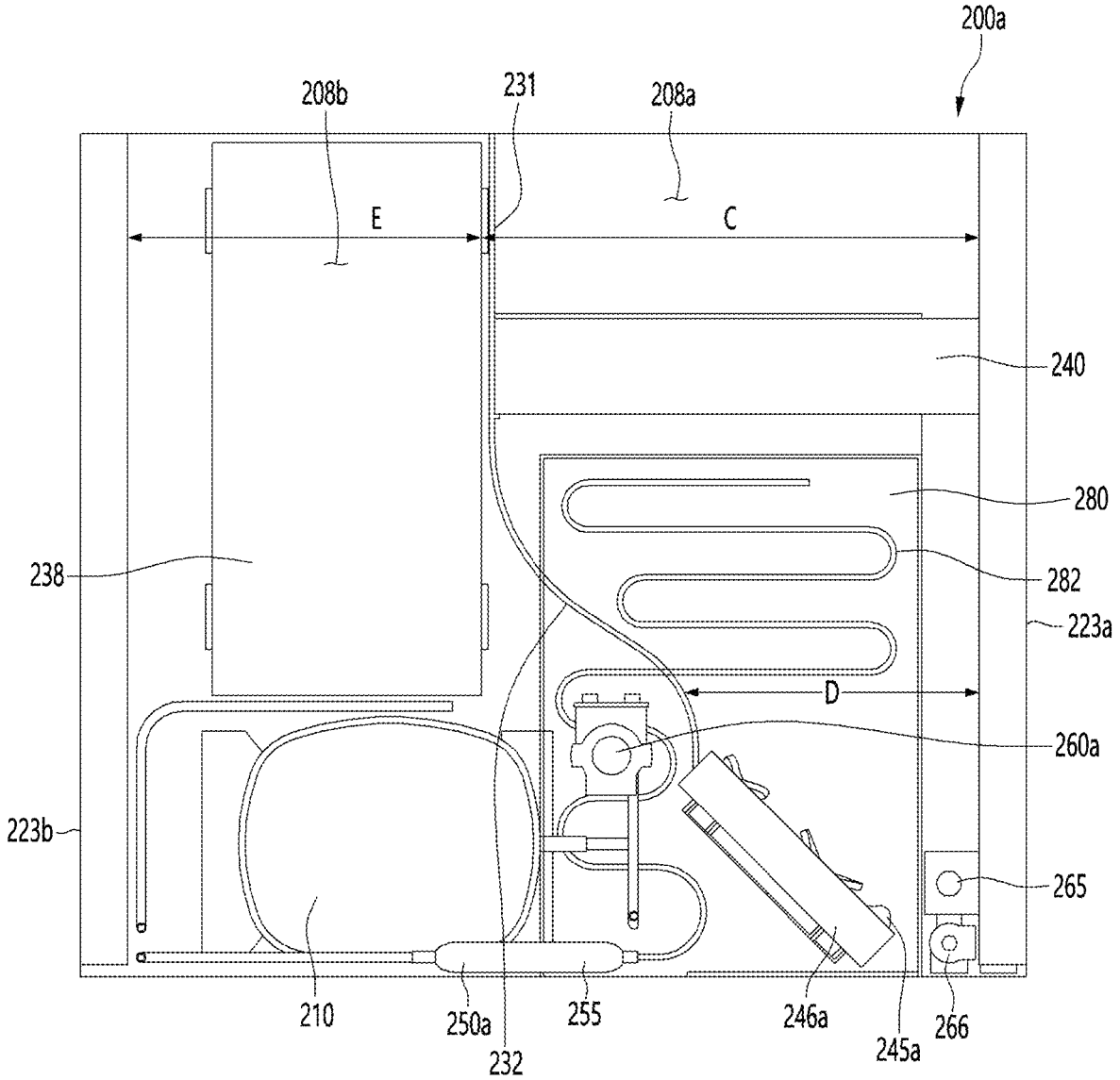
FIG. 18 is a plan view illustrating the constituents of the machine room according to the second embodiment.

FIG. 16 is a rear view of a machine room in an under counter type refrigerator according to a second embodiment, FIG. 17 is a front perspective view illustrating constituents of the machine room according to the second embodiment, and FIG. 18 is a plan view illustrating the constituents of the machine room according to the second embodiment.

Referring to FIGS. 16 to 18, a compressor 210, a condenser 240, and a dryer 250*a* may be installed in a machine room 200*a* to drive a refrigeration cycle according to the second embodiment. The compressor 210, the condenser 240, and the dryer 250*a* may be connected by a refrigerant pipe 255.

The dryer 250*a* may include a dryer body that is disposed at a position lower than a first upper plate 225 and higher than a center of a condensation fan 245*a* and extends in a horizontal direction.

Among the components according this embodiment, the description of the components that are given by the same reference numerals as the components according to the first embodiment may be denoted by the description of the first embodiment.

Air outside the refrigerator 100 is introduced into a first space from a front side of the refrigerator 100 to cool the condenser 240. Also, the air flows towards the back to cool the compressor 210 while passing through the compressor 210 via the condensation fan 245*a*.

Thereafter, the air may pass through a control box 238 disposed in front of the compressor 210 to cool the control box 238, and then be discharged to the front side of the refrigerator 100.

The condensation fan 245*a* according to this embodiment may be installed on a guide wall 230, the condenser 240 may be disposed in the first space, and the compressor 210 and the control box 238 may be disposed in a second space.

In detail, an inner space of the machine room 200*a* may be configured to be divided into the first space and the second space by the guide wall 230. The first and second spaces may be arranged at left and right sides, respectively.

When the refrigerator 100 is viewed from the front side, the machine room 200*a* may be divided into the left and right sides with respect to the guide wall 230, and the condenser 240 may be disposed in the first space corresponding to the left side. Also, the control box 238 may be disposed in the second space corresponding to the right side.

A fan shroud 246*a* is provided at a rear side of the guide wall 230. In another aspect, the fan shroud 246*a* may be provided at a rear portion of the guide wall 230*a*. The fan shroud 246*a* may be arranged to be inclined by a set angle with respect to a front or rear surface of the machine room 200*a*. For example, the set angle may be defined in a range of about 35° to about 55°.

The condensation fan 245*a* is installed in the fan shroud 246*a*. The condensation fan 245*a* may rotate inside the fan shroud 246*a* to generate an air flow. For example, the condensation fan 245*a* may be provided as an axial flow fan.

Due to the inclined arrangement of the fan shroud 246*a*, the condensation fan 245*a* may also be inclined with respect to the front or rear surface of the machine room 200*a*.

The machine room 200*a* further includes a valve 260*a* that distributes the refrigerant condensed in the condenser 240 to a first evaporator 131 and a second evaporator 141. The valve 260*a* includes a three-way valve.

The valve 260*a* is disposed at a rear portion of the second space 236, and the valve 260*a* may be supported on a defrosting water tray 280.

In detail, a valve bracket 263*a* may be provided above the defrosting water tray 280. The valve bracket 263*a* may extend upward from an upper end of the defrosting water tray 280 and be coupled to the valve 260*a*.

The condensation fan 245*a* may be disposed to be spaced a predetermined height upward from the lower plate 221. For example, a lower end of the condensation fan 245*a* may be disposed at a position corresponding to the upper end of the defrosting water tray 280. Thus, a phenomenon in which the air flow is disturbed by the defrosting water existing in the defrosting water tray 280 may be prevented from occurring.

A first center of the compressor 210 in the vertical direction and a second center of the condensation fan 245*a* in the vertical direction may be defined at the same height. That is, an extension line connecting the first center to the second center may be parallel to the lower plate 221. Due to the arrangement of the compressor 210 and the condensation fan 245*a*, air discharged from the condensation fan 245*a* may easily cool the compressor 210.

Figure 19:
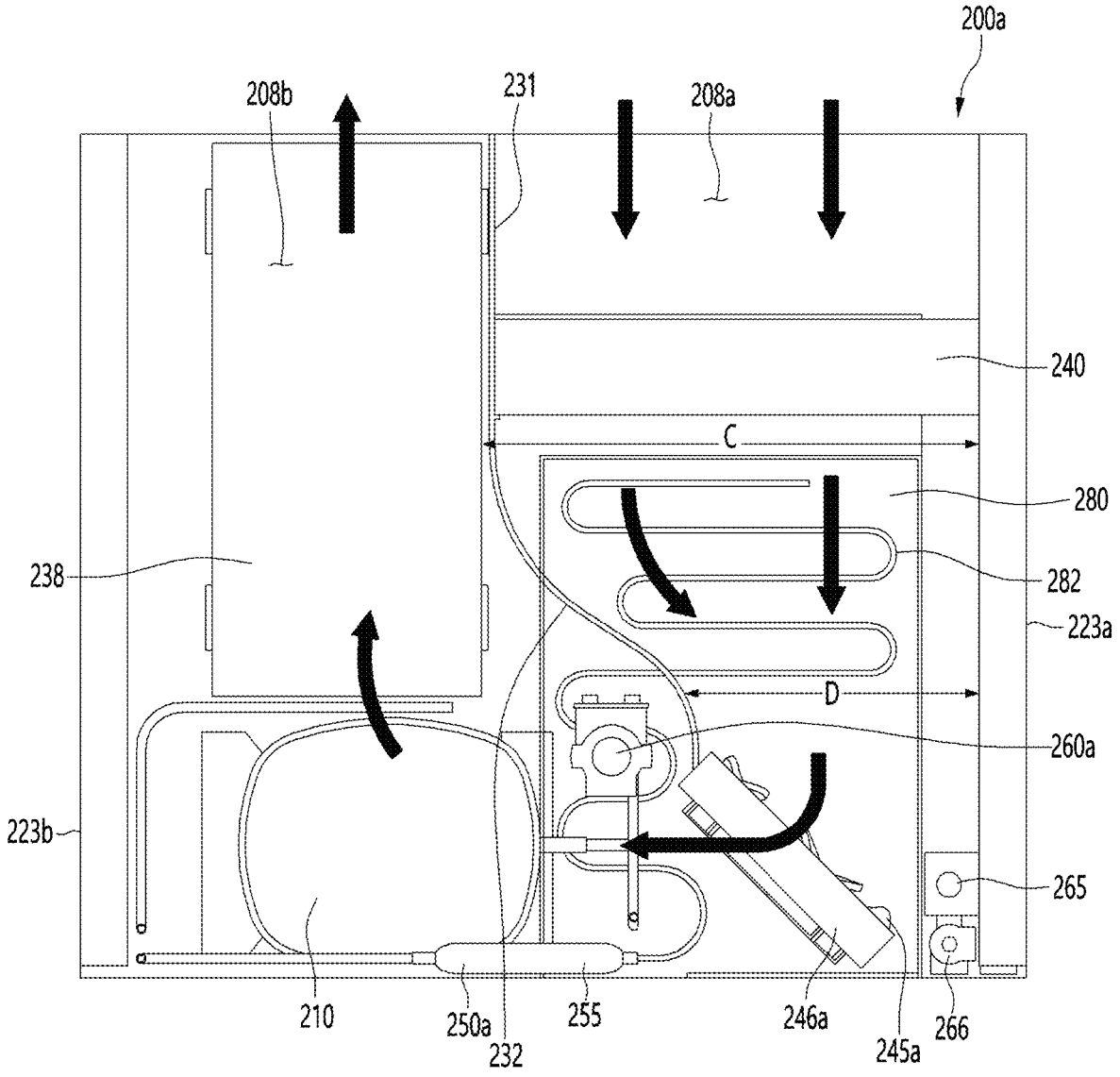
FIG. 19 is a view illustrating a state in which air in the machine room flows according to the second embodiment.

FIG. 19 is a view illustrating a state in which air in the machine room flows according to the second embodiment.

Referring to FIG. 19, a heat dissipation passage through which air flows through the machine room 200*a* will be described. When the condensation fan 245*a* is driven, air outside the refrigerator is introduced into the first space 235 from the front side through a suction grill 203.

The air introduced into the first space 235 flows towards the back, passes through the condenser 240, and passes through an upper space of the defrosting water tray 280 to assist in the evaporation of the defrosting water.

The air may be suctioned into the condensation fan 245*a* and be switched laterally from the first space 235 towards the second space 236. Here, in the condensation fan 245*a*, since an axial line of the condensation fan 245*a* is disposed to be inclined towards rear and side surfaces of the machine room, air in the first space 235 may be easily suctioned into the condensation fan 245*a*.

The air discharged from the condensation fan 245*a* may cool the compressor 210 while passing through the compressor 210.

The air passing through the compressor 210 flows to the front side to cool the control box 238 while passing through the control box 238 disposed in front of the compressor 210.

The air passing through the control box 238 may flow forward and be discharged to the front side of the refrigerator through the discharge grill 205.

A refrigerant flow will be described below.

The high-temperature refrigerant compressed by the compressor 210 flows through a tray pipe 282 to assist in the evaporation of the defrosting water stored in the defrosting water tray 280.

The refrigerant passing through the tray pipe 282 may be introduced into the condenser 240 and be condensed, and then, moisture or foreign substances may be separated from the refrigerant while the refrigerant passes through the dryer 250*a*.

The refrigerant passing through the dryer 250*a* flows into the valve 260*a* and is branched from the valve 260 to flow towards the first and second evaporators 231 and 241. A capillary (not shown) may be provided at an inlet-side of each of the first and second evaporators 231 and 241, and the refrigerant may be decompressed in the capillary, and then be introduced into the first and second evaporators 231 and 241 and be evaporated.

The refrigerant evaporated in the first and second evaporators 231 and 241 may be suctioned again into the compressor 210, and thus, the circulation described above may be repeated.

Figure 20:
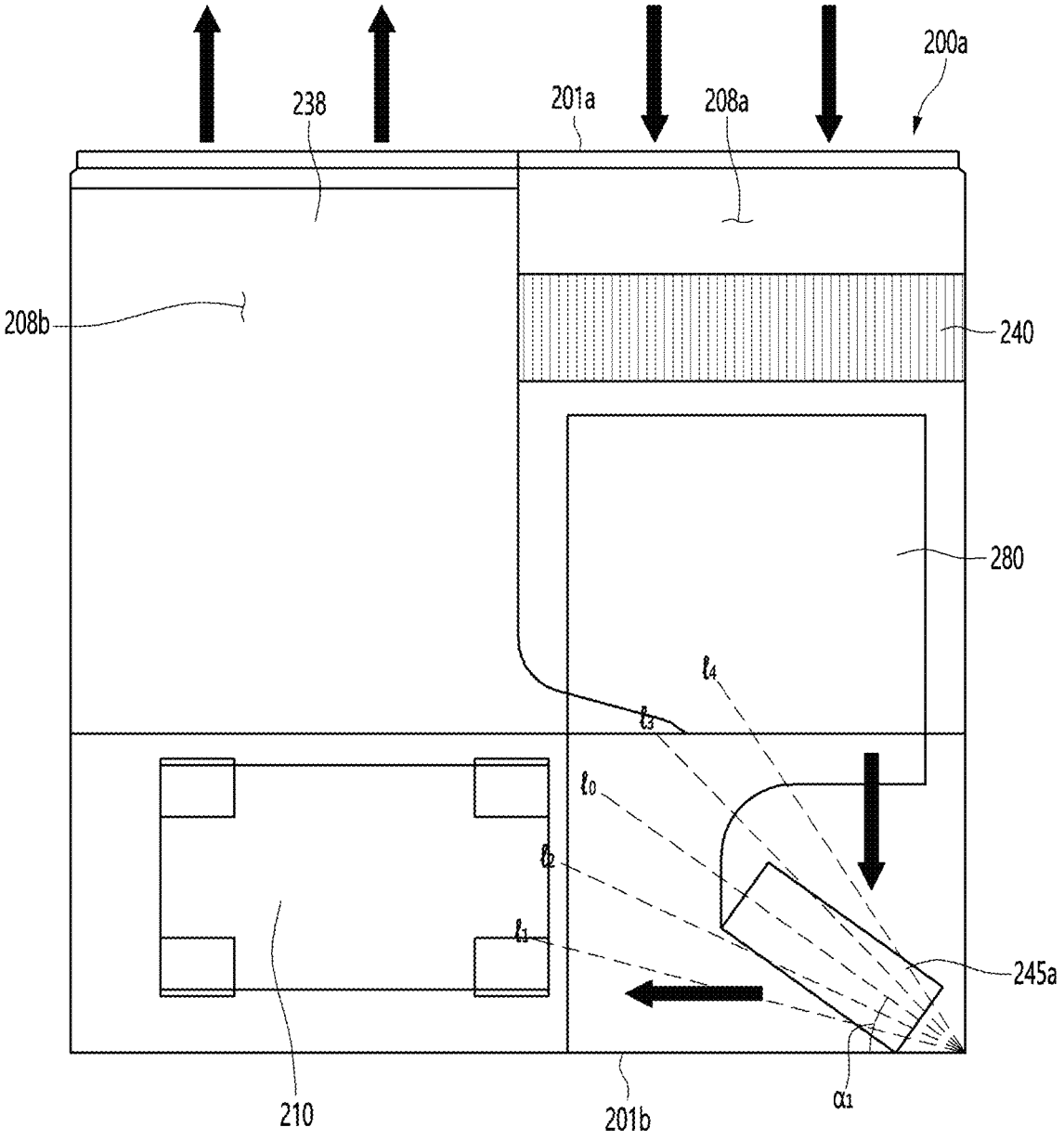
FIG. 20 is a plan view illustrating a state in which a condensation fan is disposed to be inclined in the machine room according to the second embodiment.
Figure 21:
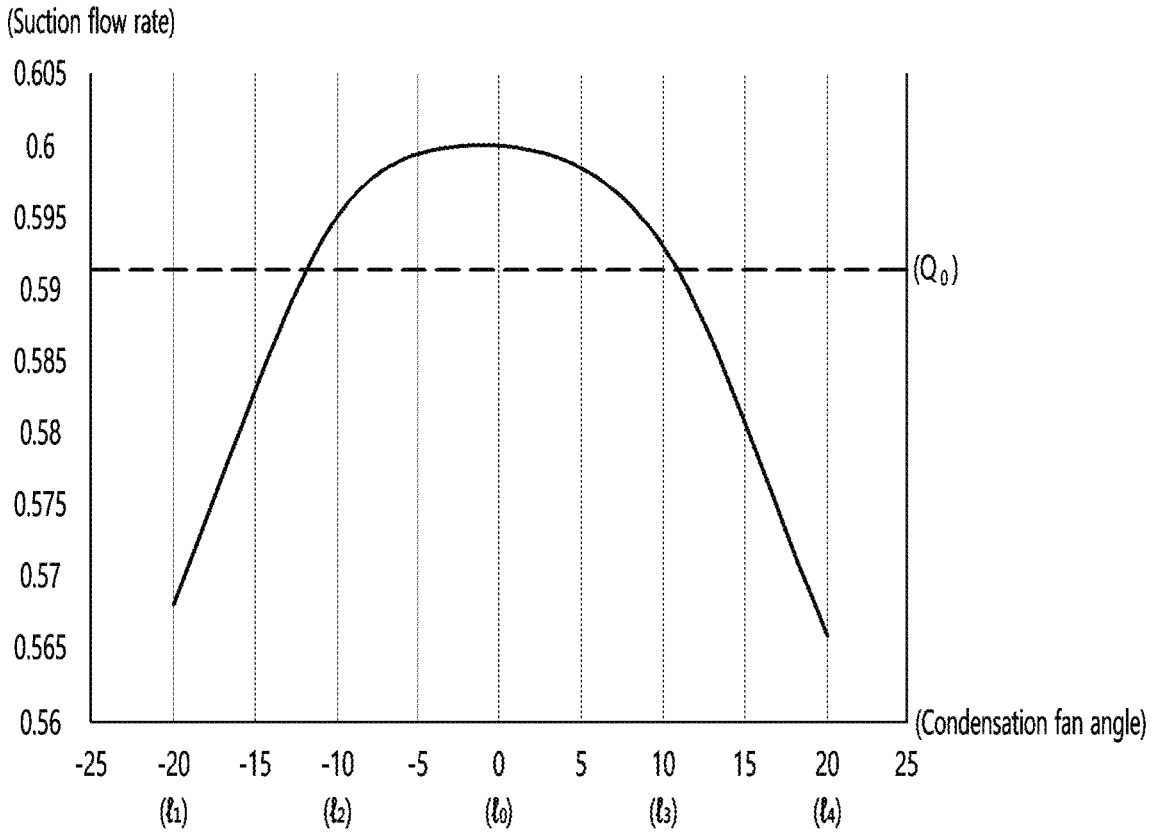
FIG. 21 is a graph illustrating results obtained by measuring a suction flow rate depending on the inclined arrangement of the condensation fan according to the second embodiment.

FIG. 20 is a plan view illustrating a state in which the condensation fan is disposed to be inclined in the machine room according to the second embodiment, and FIG. 21 is a graph illustrating results obtained by measuring a suction flow rate depending on the inclined arrangement of the condensation fan according to the second embodiment.

Referring to FIG. 20, the condensation fan 245*a* according to an embodiment may be disposed to be inclined at a set angle α1 with respect to a front surface 201*a* or a rear surface 201*b* of the machine room 200*a*. The front surface 201*a* and the rear surface 201*b* of the machine room 200 may be parallel to each other.

In other words, a center line in the vertical direction with respect to the axial line of the condensation fan 245*a* may be arranged to be inclined at a set angle α1 with respect to the front surface 201*a* or the rear surface 201*b* of the machine room 200*a*.

A suction passage 208*a* and a discharge passage 208*b* inside the machine room 200*a* may be directed forward and backward, and the condensation fan 245*a* may be inclined with respect to the suction passage 208*a* or the discharge passage 208*b*. In other words, an axial direction of the condensation fan 245*a* may be defined to cross the front and rear direction.

The axial line of the condensation fan 245*a* may be arranged to pass through the rear surface 201*b* and the side surface (side plate) of the machine room 200*a*.

According to this configuration, since the front surface of the condensation fan 245*a* is disposed to face the front end of the machine room 200*a*, the air flowing through the suction passage 208*a* may be suctioned into the condensation fan 245*a* without excessive bending.

The set angle α1 may be defined in a range of about 35° to about 55°.

Five center lines l0, l1, l2, l3, l4, which are illustrated in FIG. 20, may be understood as center lines (extending lines perpendicular to the axial line), respectively, when the inclined angles of the condensation fans 245*a* varies.

In detail, the first center line l0 perpendicular to the axial line of the condensation fan 245*a* disposed to be inclined is understood as a center line that is angled at an angle of about 45° with respect to the front surface 201*a* or the rear surface 201*b* of the machine room 200*a*.

For another example, the second center line l1 perpendicular to the axial line of the condensation fan 245*a* disposed to be inclined may be understood as a center line that is angled at an angle of about 25° with respect to the front surface 201*a* or the rear surface 201*b* of the machine room 200*a*. That is, the second center line l1 may be a center line rotating at an angle of about 20°(−20°) in a counter-clockwise direction (see FIG. 20) with respect to the first center line l0.

For further another example, the third center line l2 perpendicular to the axial line of the condensation fan 245*a* disposed to be inclined may be understood as a center line that is angled at an angle of about 35° with respect to the front surface 201*a* or the rear surface 201*b* of the machine room 200*a*. That is, the third center line l2 may be a center line rotating at an angle of about 10° (−10°) in the counter-clockwise direction (see FIG. 20) with respect to the first center line l0.

For further another example, the fourth center line l3 perpendicular to the axial line of the condensation fan 245*a* disposed to be inclined may be understood as a center line that is angled at an angle of about 55° with respect to the front surface 201*a* or the rear surface 201*b* of the machine room 200*a*. That is, the fourth center line l3 may be a center line rotating at an angle of about 10° (+10°) in the clockwise direction (see FIG. 20) with respect to the first center line l0.

For further another example, the fifth center line l4 perpendicular to the axial line of the condensation fan 245*a* disposed to be inclined may be understood as a center line that is angled at an angle of about 65° with respect to the front surface 201*a* or the rear surface 201*b* of the machine room 200*a*. That is, the fifth center line l4 may be a center line rotating at an angle of about 20° (+20°) in the clockwise direction (see FIG. 20) with respect to the first center line M.

Referring to the graph of FIG. 21, a horizontal axis shows the inclined angle of the condensation fan 245*a*, and a vertical axis shows a change in suction flow rate according to the inclined angle of the condensation fan 245*a*.

TABLE 1

| Condensation fan angle (°) | Suction flow rate (CMM) |
|---|---|
| −20 (l1) | 0.568 |
| −10 (l2) | 0.595 |
| 0 (l0) | 0.6 |
| 10 (l3) | 0.593 |
| 20 (l4) | 0.566 |

[Table 1] above illustrates change values of a suction flow rate, which are measured according to the inclined angle of the condensation fan 245*a* when the condensation fan 245*a* is disposed to be inclined so as to define the five center lines l0, l1, l2, l3, and l4.

In detail, when the condensation fan 245*a* is disposed to be inclined so that a center line of the condensation fan 245*a* passes through the first center line l0, the condensation fan 245*a* is disposed to be inclined at an angle of about 45° with respect to the front surface 201*a* or the rear surface 201*b* of the machine room 200*a*. Here, a suction flow rate represents about 0.6 CMM.

When the condensation fan 245*a* is disposed to be inclined so that a center line of the condensation fan 245*a* passes through the second center line l1, the condensation fan 245*a* is disposed to be inclined at an angle of about 25° with respect to the front surface 201*a* or the rear surface 201*b* of the machine room 200*a*. Here, a suction flow rate represents about 0.568 CMM.

When the condensation fan 245*a* is disposed to be inclined so that a center line of the condensation fan 245*a* passes through the third center line l2, the condensation fan 245*a* is disposed to be inclined at an angle of about 35° with respect to the front surface 201*a* or the rear surface 201*b* of the machine room 200*a*. Here, a suction flow rate represents about 0.595 CMM.

When the condensation fan 245*a* is disposed to be inclined so that a center line of the condensation fan 245*a* passes through the fourth center line l3, the condensation fan 245*a* is disposed to be inclined at an angle of about 55° with respect to the front surface 201*a* or the rear surface 201*b* of the machine room 200*a*. Here, a suction flow rate represents about 0.593 CMM.

When the condensation fan 245*a* is disposed to be inclined so that a center line of the condensation fan 245*a* passes through the fifth center line l4, the condensation fan 245*a* is disposed to be inclined at an angle of about 65° with respect to the front surface 201*a* or the rear surface 201*b* of the machine room 200*a*. Here, a suction flow rate represents about 0.566 CMM.

In the refrigerator according to an embodiment, to secure sufficient heat dissipation capacity, it is necessary to secure a suction flow rate of about 0.590 CMM or more. The angle of the condensation fan 245*a* that satisfies this condition has be defined at an angle between the third center line l2 and the fourth center line l3 with respect to the first center line l0.

In this case, the inclination angle of the condensation fan 245*a* with respect to the front surface 201*a* or the rear surface 201*b* of the machine room 200*a* may be in a range of about 35° to about 55°. In this inclined angle range, it is possible to achieve an increase in suction flow rate.

Figure 22:
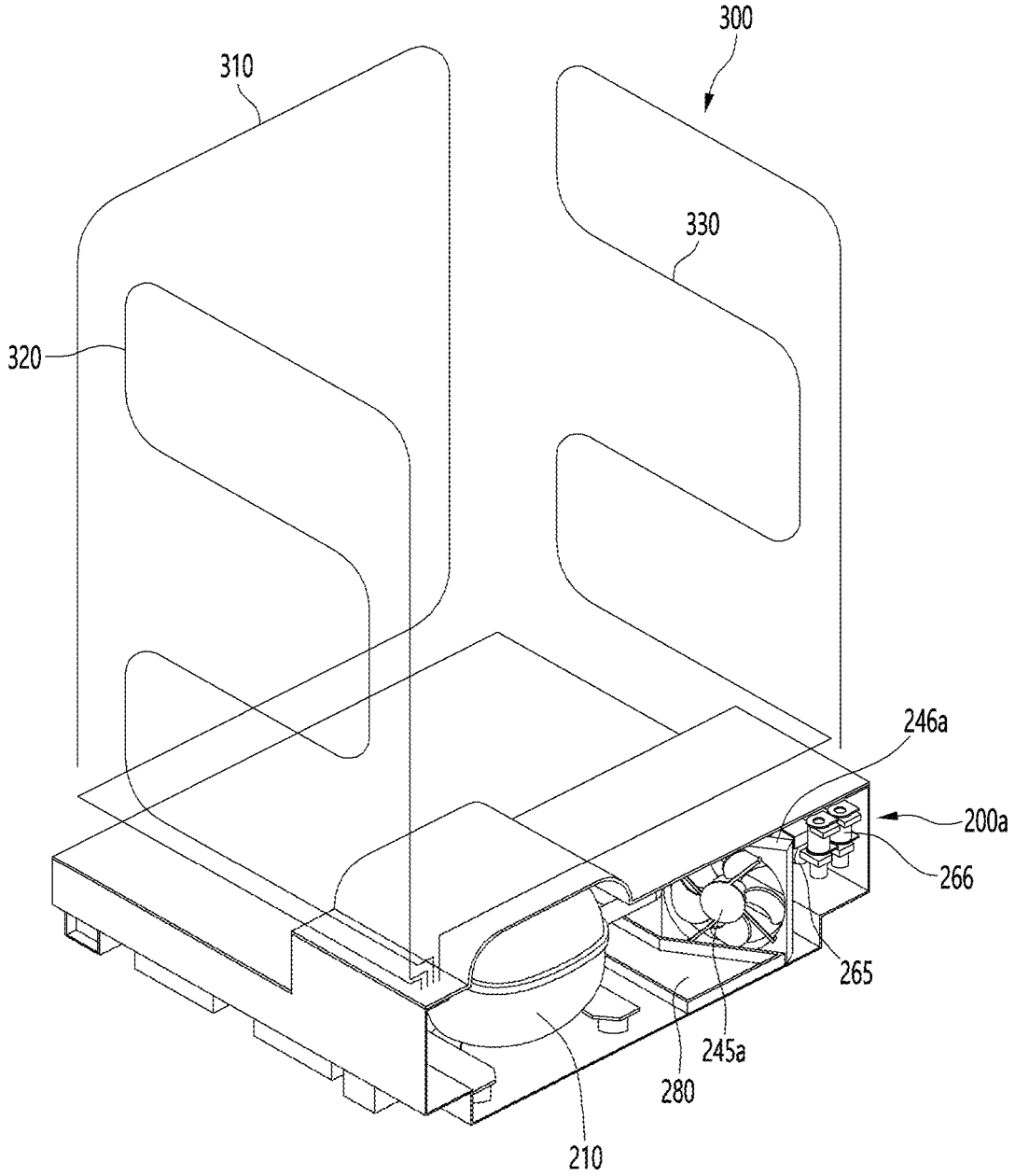
FIG. 22 is a schematic view illustrating a configuration of a wall condenser provided with a front surface and a side surface of the under counter type refrigerator according to the second embodiment.

FIG. 22 is a schematic view illustrating a configuration of the wall condenser provided with the front surface and the side surface of the under counter type refrigerator according to the second embodiment.

Referring to FIG. 22, the under counter type refrigerator 100 further includes a wall condenser 300. A plurality of under counter type refrigerators 100 may be arranged side by side in the horizontal direction so as to be adjacent to the furniture 1, and when a temperature of an outer wall of the refrigerator has a low temperature below a dew point temperature due to an influence of the adjacent refrigerator, dew may be generated on a surface of the refrigerator.

Thus, in this embodiment, the wall condenser 300 through which a high-temperature refrigerant flows may be installed on a sidewall of the refrigerator 100 to prevent dew from being generated on the surface of the refrigerator.

The wall condenser 300 may be configured to be embedded in the insulating material 113 between the outer case 111 and the inner case 112. The refrigerant condensed in the condenser 240 may be introduced into the wall condenser 300, and the refrigerant passing through the wall condenser 300 may flow to the dryer 250.

The wall condenser 300 includes a first condensation portion 310 provided on a front edge of the main body 110, a second condensation portion 320 provided on one sidewall of the main body 110, and a third condensation portion 330 disposed on the other sidewall.

Descriptions of the first to third condensation portions 310, 320, and 330 will be denoted by the first to third condensation portions 310, 320, and 330 according to the first embodiment.

Since the wall condenser 300 is provided, when a refrigerant flows in the wall condenser 300, the sidewall of the refrigerator body 110 may be maintained above a dew point temperature. Referring to FIG. 15, the sidewall of the main body 110 may have temperatures above the dew point temperature, i.e., temperatures indicated as red, yellow, and green colors. Thus, the generation of the dew on the outer wall of the refrigerator may be prevented.

Hereinafter, in the under counter type refrigerator according to an embodiment, the description will be given with reference to the drawings for added contents of a configuration for improving user convenience.

Figure 23A:
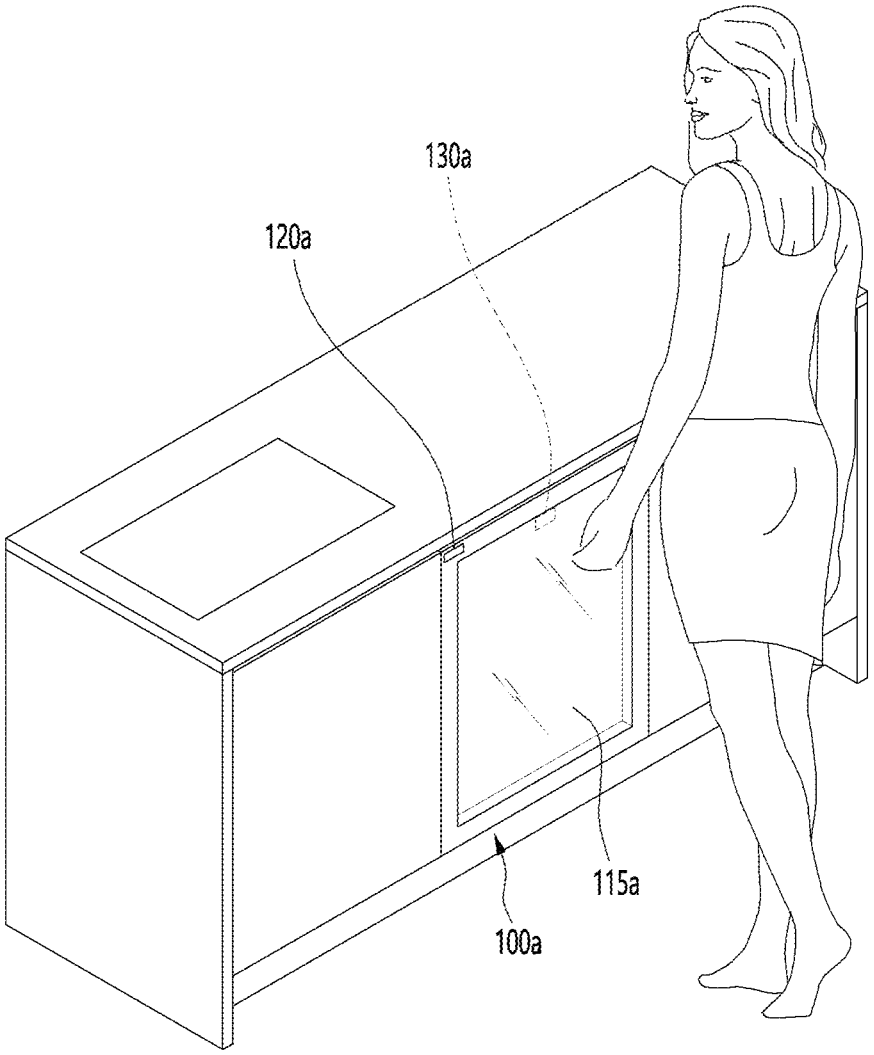
FIGS. 23A and 23B are views illustrating a state in which a lighting of the refrigerator operates when a user approaches the under counter type refrigerator according to an embodiment.
Figure 23B:
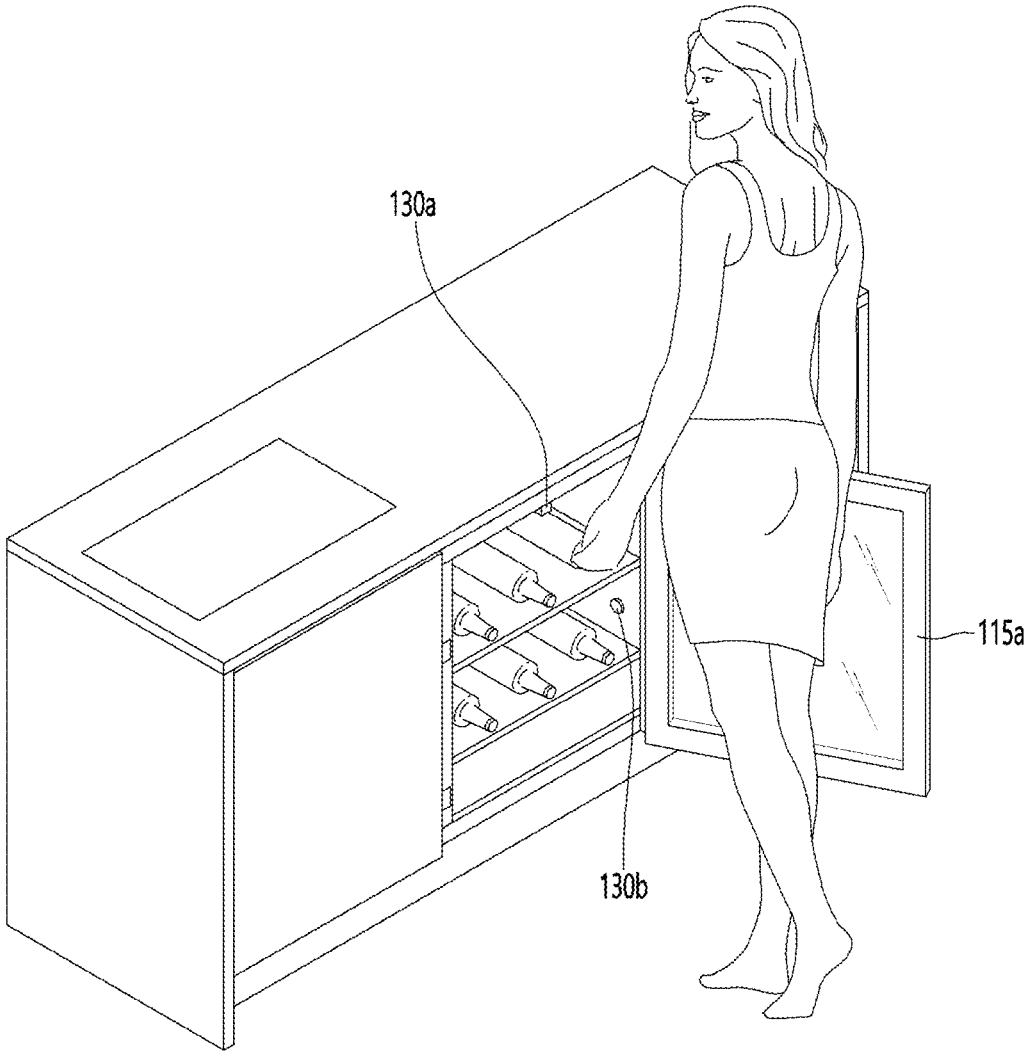

FIGS. 23A and 23B are views illustrating a state in which a lighting of the refrigerator operates when the user approaches the under counter type refrigerator according to an embodiment.

Referring to FIGS. 23A and 23B, an under counter type refrigerator 100*a* according to an embodiment includes a refrigerator capable of storing drinks or wine. The refrigerator 100*a* includes a transparent door 115*a* capable of seeing the inside thereof.

The refrigerator 100*a* may be configured to sense user's access so as to turn on the lighting inside the refrigerator.

In detail, the refrigerator 100*a* includes a proximity sensor 120*a* that senses the user's access. For example, the proximity sensor 120*a* may include an infrared sensor.

The proximity sensor 120*a* may be provided on a front surface or a door of the refrigerator body.

The refrigerator 100*a* further includes lightings 130*a* and 130*b* that brightly illuminate the storage compartment of the refrigerator 100*a*. The lightings 130*a* and 130*b* may include an upper lighting 130*a* provided at an upper portion of the storage compartment and a lower lighting 130*b* provided at a lower portion of the storage compartment.

An operation of the refrigerator according to this embodiment will be briefly described.

When the user approaches within a set distance of the refrigerator 100*a* to stay for a first predetermined time or more, the upper lighting 130*a* may be turned on to brighten an upper space of the storage compartment, and the inside of the storage compartment may be seen through the transparent door 115*a*. For example, the first set time may be about 1 second.

When the user approaches within the set distance of the refrigerator 100*a* to stay for a second predetermined time or more, the lower lighting 130*b* as well as the upper lighting 130*a* may be turned on to brighten the whole space of the storage compartment, and the inside of the storage compartment may be seen through the transparent door 115*a*. For example, the second set time may be about 2 seconds.

The user may check food stored in the refrigerator and open the transparent door 115*a* to take out the food. Due to this configuration and operation, the ease of use of the refrigerator 100*a* increases.

Figure 24:
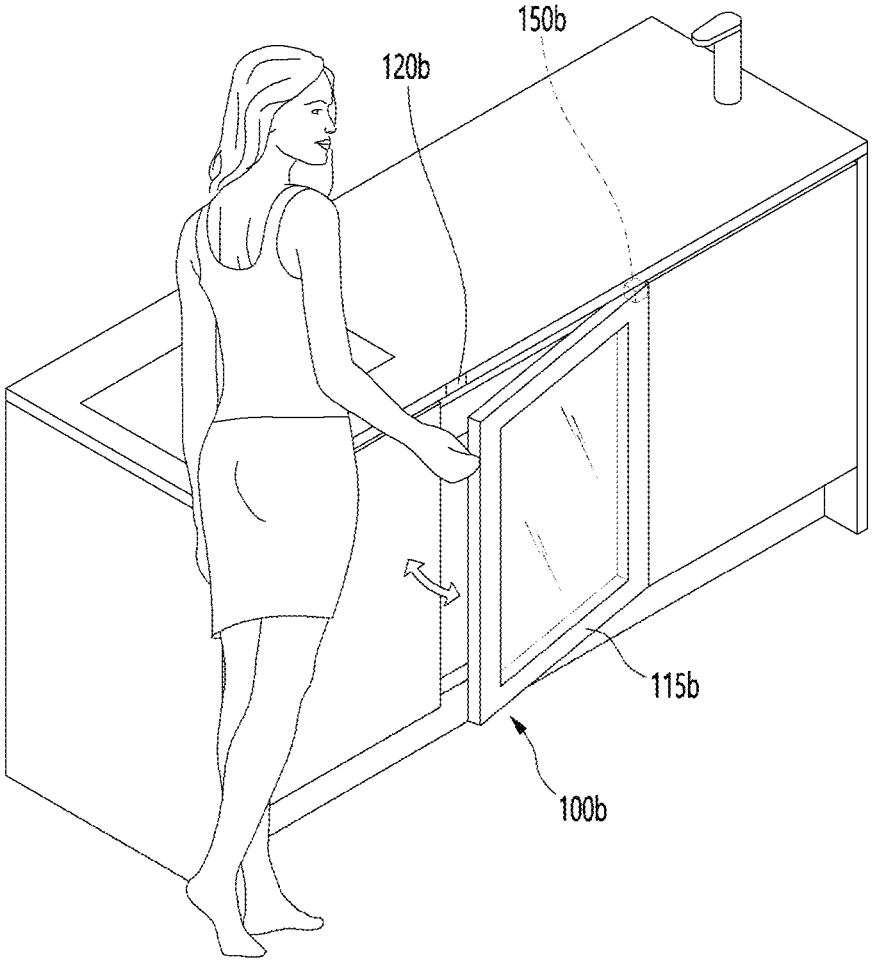
FIG. 24 is a view illustrating a state in which a door rotates to be opened and closed according to touch manipulation in the under counter type refrigerator according to an embodiment.
Figure 25:
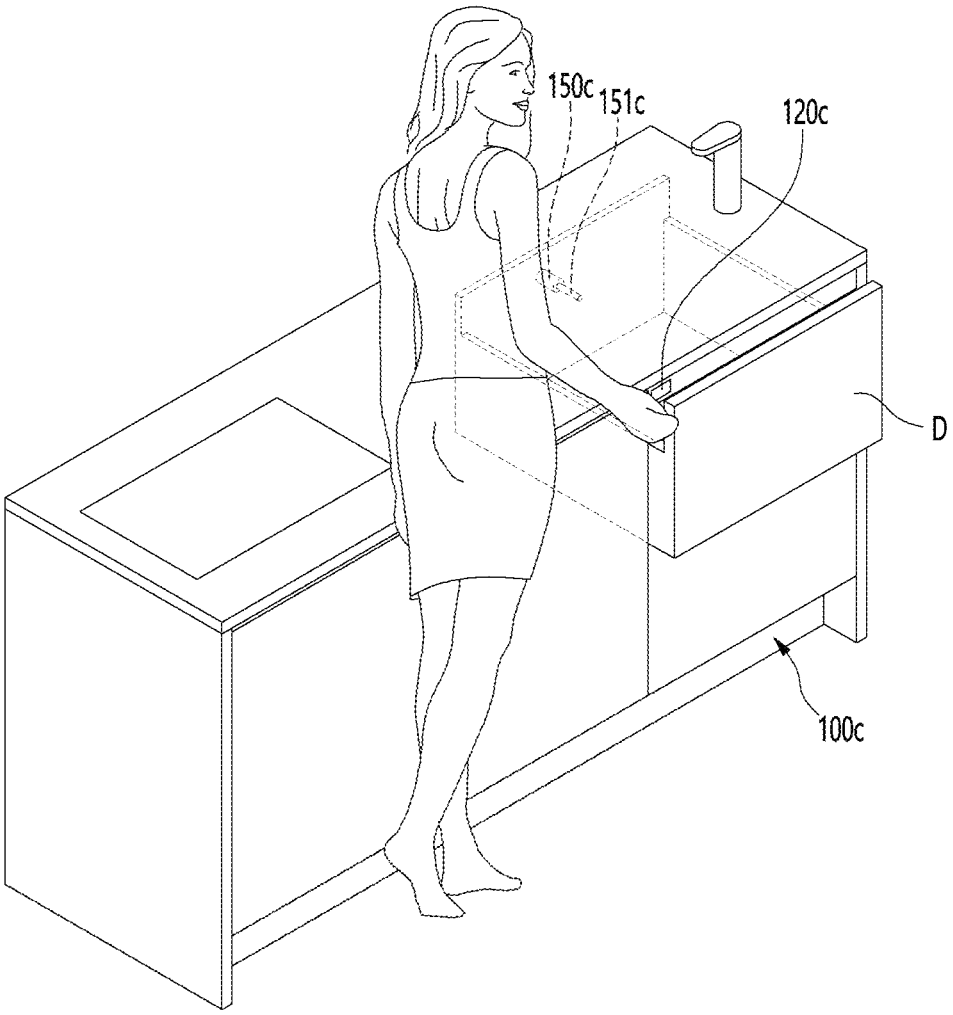
FIG. 25 is a view illustrating a state in which the door is slid to be opened and closed according to the touch manipulation in the under counter type refrigerator according to an embodiment.
Figure 26:
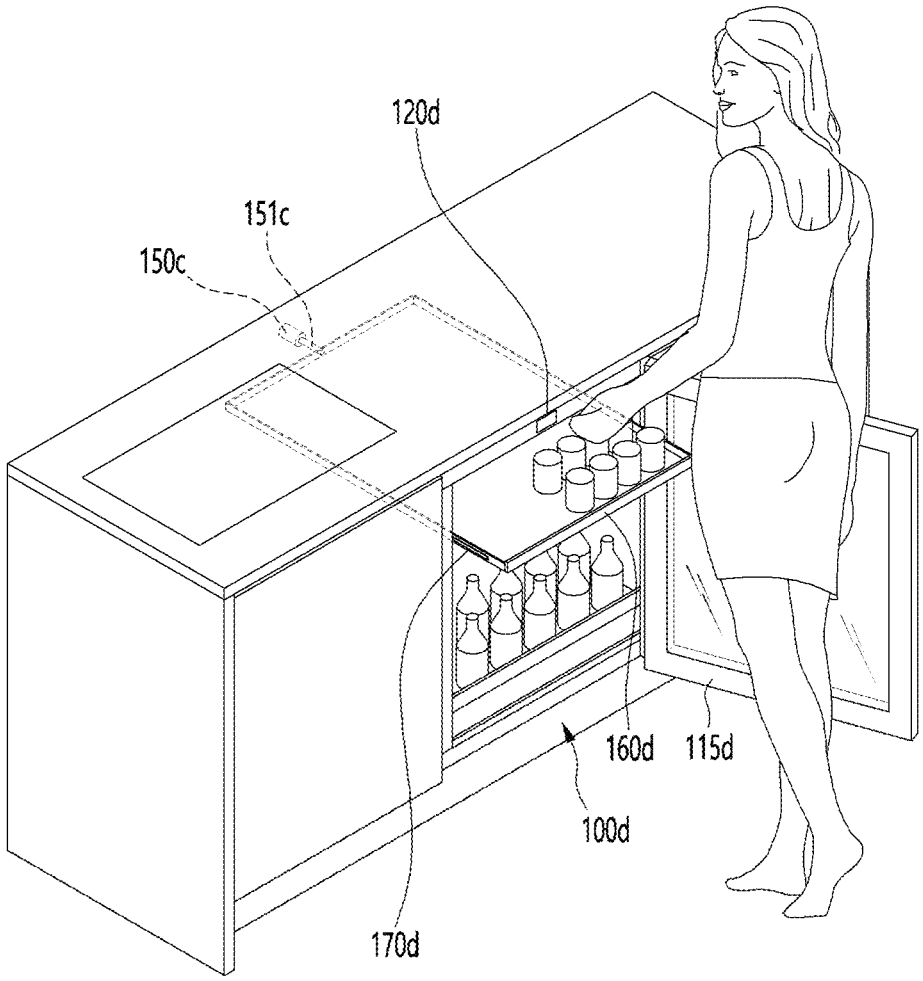
FIG. 26 is a view illustrating a state in which a shelf within a storage compartment is slid out according to the touch manipulation in the under counter type refrigerator according to an embodiment.

FIG. 24 is a view illustrating a state in which the door rotates to be opened and closed according to touch manipulation in the under counter type refrigerator according to an embodiment, FIG. 25 is a view illustrating a state in which the door is slid to be opened and closed according to the touch manipulation in the under counter type refrigerator according to an embodiment, and FIG. 26 is a view illustrating a state in which a shelf within a storage compartment is slid out according to the touch manipulation in the under counter type refrigerator according to an embodiment.

Referring to FIGS. 24 to 26, the door of the under counter type refrigerator may be opened by a user's touch manner, or an inner shelf may be withdrawn.

Referring first to FIG. 24, the under counter type refrigerator 100*b* includes a touch sensor 120*b*. For example, the touch sensor 120*b* may be provided on the front surface or the door of the refrigerator body.

When the user manipulates the touch sensor 120*b*, the door 115*b* may be opened.

The door 115*b* may be hinge-coupled to the refrigerator body and rotate forward with respect to a hinge so as to be opened.

The refrigerator 100*b* further includes a hinge motor 150*b* that provides driving force for opening the door 115*b*. The hinge motor 150*b* may be connected to a shaft of the hinge to rotate about the axis so as to open the door 115*b*.

Next, referring to FIG. 25, the under counter type refrigerator 100*c* includes a touch sensor 120*c*. For example, the touch sensor 120*c* may be provided on the front surface of the refrigerator body or may be provided on a drawer D that is withdrawable forward.

When the user manipulates the touch sensor 120*c*, the drawer D may be opened.

The refrigerator 100*c* further includes a push motor 150*c* that provides driving force for opening the drawer D. The push motor 150*c* may be provided on the inner rear wall of the refrigerator body.

The push motor 150*c* may allow a pressing member 151*c* pressing the drawer D forward to move forward. When the pressing member 151*c* moves forward, the drawer D may be pressed by the pressing member 151*c* and be withdrawn forward.

Next, referring to FIG. 26, the under counter type refrigerator 100*d* includes a door 115*d*. The door 115*d* may be hinge-coupled to the refrigerator body and rotate forward with respect to the hinge so as to be opened.

A shelf 160*d* for storing food is provided inside the refrigerator body. The shelf 160*d* may be provided to be withdrawable forward.

The refrigerator 100*d* includes a touch sensor 120*d*. For example, the touch sensor 120*d* may be provided on the front surface of the refrigerator body. When the user manipulates the touch sensor 120*d*, the shelf 160*d* may be withdrawn forward.

The refrigerator 100*d* further includes a push motor 150*c* that provides driving force for withdrawing the shelf 160*d*. The push motor 150*c* may be provided on the inner rear wall of the refrigerator body.

The push motor 150*c* may allow the pressing member 151*c* pressing the shelf 160*d* forward to move forward. When the pressing member 151*c* moves forward, the shelf 160*d* may be pressed by the pressing member 151*c* and be withdrawn forward.

Figure 27:
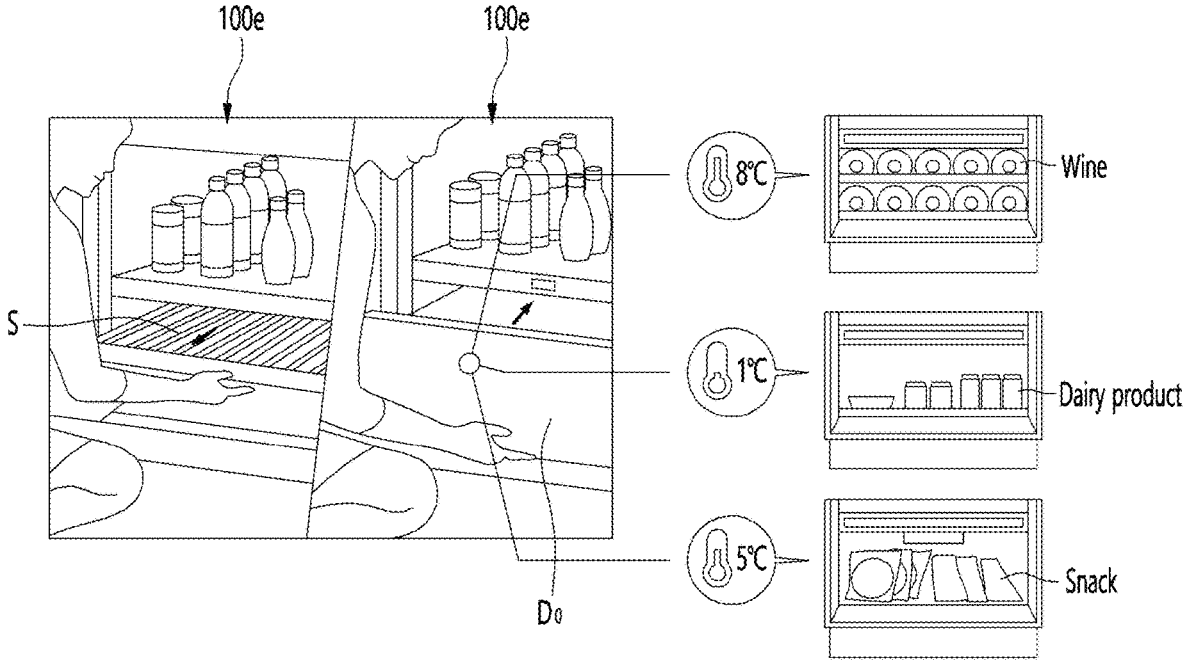
FIG. 27 is a view illustrating a state in which an inner storage compartment of the under counter type refrigerator serves as a convertible storage compartment according to an embodiment.

FIG. 27 is a view illustrating a state in which the inner storage compartment of the under counter type refrigerator serves as the convertible storage compartment according to an embodiment.

Referring to FIG. 27, the under counter type refrigerator 100*e* according to an embodiment may include a plurality of storage compartments that are independently adjusted in temperature.

Any one of the plurality of storage compartments may be configured as a convertible storage compartment that is capable of changing a storage temperature according to types of food being stored. For example, the convertible storage compartment may be selectively implemented as a wine storage compartment in which a temperature is capable of being adjusted in a range of about 5° C. to 18° C., a dairy product storage compartment in which a temperature is capable of being adjusted in a range of about 0° C. about 5° C., or a snack storage compartment in which a temperature is capable of being adjusted in a range of about 5° C. to about 8° C.

Of course, the storage compartment may be configured to define a temperature range below zero to enable food to be stored in a frozen state.

In the convertible storage compartment, a shelf S or a drawer Do may be installed depending on the type of food being stored. That is, the shelf S or the drawer Do may be detachably installed inside the storage compartment of the refrigerator.

As described above, since the convertible storage compartment is provided in the under counter type refrigerator, a storage compartment temperature in a specific temperature range may be implemented according to user's preference, and thus the user's convenience may be improved.

Figure 28:
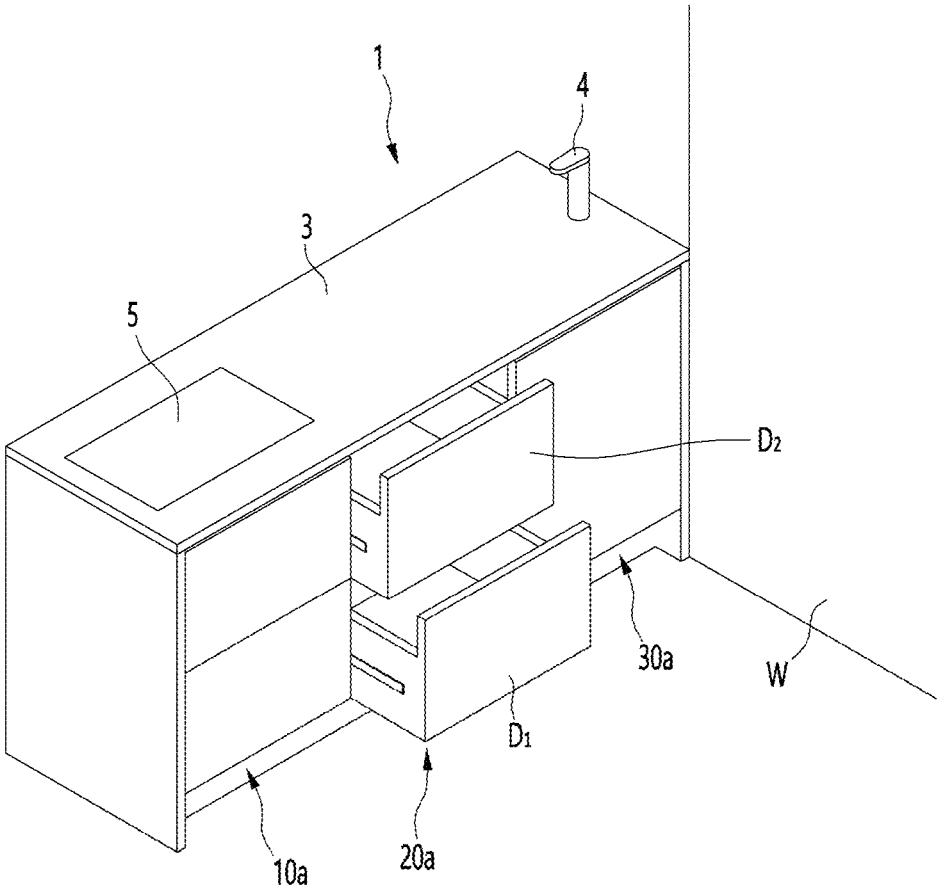
FIG. 28 is a perspective view illustrating a state in which an under counter type refrigerator is installed in kitchen furniture according to another embodiment.

FIG. 28 is a perspective view illustrating a state in which an under counter type refrigerator is installed in kitchen furniture according to another embodiment.

Referring to FIG. 28, under counter type refrigerators 10*a*, 20*a*, and 30*a* according to another embodiment may be installed in kitchen furniture 1.

The under counter type refrigerators 10*a*, 20*a*, and 30*a* may be disposed to be adjacent to each other in the left and right direction. The under counter type refrigerators 10*a*, 20*a*, and 30*a* include drawers D1 and D2 that are withdrawable forward.

The drawers D1 and D2 may be provided in plurality and disposed in the vertical direction. The plurality of drawers D1 and D2 include a first drawer D1 and a second drawer D2 above the first drawer D1.

A basket that stores food is provided behind the drawer D1, and the basket and the drawer D1 may be withdrawable forward. Due to this structure, the user's convenience may be improved.

According to the above-described technical solutions, a compact machine room may be realized to increase in capacity of the storage compartment. Particularly, the height of the machine room may be relatively low so as not to largely reduce the capacity of the storage compartment even though the refrigerator decreases in height.

The heat dissipation passage of the machine room, through which the air is suctioned forward into and discharged from the machine room, may be provided.

The machine room may be divided into the left and right sides with respect to the guide wall of the machine room, and the compressor and the condenser may be respectively installed in the divided left and right spaces to improve the space efficiency of the components.

In this embodiment, the machine room may have the different heights. A region having a relatively high height so that the compressor is disposed and a region having a relatively low height so that the condenser is disposed, to increase in capacity of the storage compartment.

This embodiment may provide the under counter type refrigerator, in which a suction passage defined towards the back from a front surface of the refrigerator is provided, and a condensation fan is disposed to be inclined at a predetermined angle from the front surface to increase in suction capacity of the air.

In this embodiment, the two evaporators may be disposed to realize the independent temperatures for each storage compartment, and particularly, realize the freezing compartment.

In this embodiment, the defrosting water generated in the evaporator may be transferred to the machine room and then be evaporated.

In this embodiment, the user's convenience may be improved in smart lighting of a storage compartment of the refrigerator, touch open and auto closing function of a door, a touch smart shelf, and convertible temperature control function for each storage compartment.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art and fall within the scope of the appended claims.

What is claimed is:

1. An under counter refrigerator, capable of being installed in at least one or more storage spaces of a plurality of storage spaces in a kitchen furniture having a first width (W1) in a left and right direction, which is greater than a second width (W2) in a front and rear direction or a third width (W3) in a vertical direction, and the plurality of storage spaces arranged in the left and right direction, the under counter refrigerator comprising:

a main body defining at least one of a first and second storage compartments;

an evaporator to generate cool air to be supplied to the at least one of the first and second storage compartments; and a machine room provided at a lower portion of the main body to define an installation space in which a compressor and a condenser are provided, wherein the machine room comprises:

a suction portion provided in front of the main body to suction outside air into the machine room;

a discharge portion provided in front of the main body to discharge the suctioned air from the machine room;

a guide wall to separate the installation space into a first space in which the condenser is installed, and a second space in which the compressor is installed;

a condensation fan installed at the guide wall, wherein the condenser is provided in a front portion of the first space, and a defrosting water tray is provided at a rear of the condenser, and wherein the condensation fan is disposed on one side of the defrost water tray, wherein the guide wall comprises:

a first part extending linearly in the front and rear direction; and a second part extending to be inclined or rounded towards the rear from the first part so that a left and right width of the first space is defined to decrease towards a rear side of the machine room.

2. The under counter refrigerator according to claim 1, wherein the machine room comprises a lower plate and side plates disposed at both sides of the lower plate, the installation space is defined by the lower plate and the side plates, and the guide wall protrudes upward from the lower plate between the side plates and extends backward from a front portion of the machine room.

3. The under counter refrigerator according to claim 2, wherein the guide wall extends to the rear from a front portion of the lower plate and is connected to the condensation fan, to partition the first and second spaces in the left and right direction, and the first space defines a rear space of the suction portion, and the second space defines a rear space of the discharge portion.

4. The under counter refrigerator according to claim 2, wherein the machine room further comprises an upper plate defining a bottom surface of the main body, the upper plate comprises a first upper plate disposed above the condensation fan and a second upper plate disposed above the compressor, and the first and second upper plates are disposed at heights different from each other, a dryer is disposed at a position lower than the first upper plate and higher than a center of the condensation fan and extends in a horizontal direction.

5. The under counter refrigerator according to claim 4, wherein the machine room comprises:

an inclined plate extending to be downwardly inclined forward from the first and second upper plates; and a front plate extending forward from the inclined plate.

6. The under counter refrigerator according to claim 2, wherein the defrosting water tray is placed on an upper portion of the lower plate to store defrosting water; and a tray pipe is provided in the defrosting water tray and through which a refrigerant compressed in the compressor flows.

7. The under counter refrigerator according to claim 1, wherein the condensation fan is provided at a rear side of the guide wall, and a valve is provided in a rear portion of the first space, and the compressor, the condensation fan and the valve are aligned in the left and right direction.

8. The under counter refrigerator according to claim 7, wherein a first center (Co) of the compressor in the vertical direction and a second center (C1) of the condensation fan in the vertical direction are at a same height.

9. The under counter refrigerator according to claim 1, wherein the machine room further comprises a control box installed in the second space, and the control box is disposed in front of the compressor such that the suctioned air passes through the control box to cool the control box and then be discharged from a front side of the machine room through the discharge portion.

10. The under counter refrigerator according to claim 1, wherein the main body comprises an inner case defining inner walls of the at least one of the first and second storage compartments, an outer case defining an outer appearance, and an insulator provided between the inner case and the outer case, a wall condenser through which a refrigerant condensed in the condenser flows is embedded in the insulator, and the wall condenser comprises a portion disposed in a sidewall of the main body.

11. The under counter refrigerator according to claim 10, wherein the wall condenser comprises:

a first condensation portion provided at a front surface of the main body; and second and third condensation portions provided at both sides of the first condensation portion to extend to be bent in the vertical direction.

12. The under counter refrigerator according to claim 1, further comprising:

a suction passage of the condensation fan, which is defined in the first space; and a discharge passage of the condensation fan, which is defined in the second space, wherein the condensation fan is disposed to be inclined with respect to the suction passage or the discharge passage.

13. The under counter refrigerator according to claim 12, wherein the machine room comprises a front surface and a rear surface, and the suction passage and the discharge passage are defined from the front surface towards the rear surface.

14. The under counter refrigerator according to claim 13, wherein an extension line perpendicular to an axial line of the condensation fan is inclined at a predetermined angle with respect to the rear surface.

15. The under counter refrigerator according to claim 14, wherein the predetermined angle is in a range of about 35° to about 55°.

16. The under counter refrigerator according to claim 1, further comprising:

a lighting provided inside the main body; and a proximity sensor to sense a user's access of the under counter type refrigerator, wherein a turn-on operation of the lighting is performed based on the sensing through the proximity sensor.

17. The under counter refrigerator according to claim 1, further comprising a door provided to be openable in front of the main body and a drawer provided to be withdrawable from the front of the main body, and a touch sensor, wherein the door and the drawer are movable by manipulation of the touch sensor.

18. The under counter refrigerator according to claim 1, further comprising a shelf provided inside the main body, and a touch sensor, wherein the shelf is provided to be withdrawable by manipulation of the touch sensor.

19. The under counter refrigerator according to claim 1, wherein at least one of the first and second storage compartments comprises a convertible storage compartment in which food is stored in a frozen or refrigerated state.

* * * * *